US010862258B2

(12) United States Patent
Battenfeld et al.

(10) Patent No.: US 10,862,258 B2
(45) Date of Patent: Dec. 8, 2020

(54) SET OF INTERCHANGEABLE CRIMP UNITS

(71) Applicant: WEZAG GmbH Werkzeugfabrik, Stadtallendorf (DE)

(72) Inventors: Kurt Battenfeld, Ebsdorfergrund/Wittelsberg (DE); Thomas Glockseisen, Duesseldorf (DE)

(73) Assignee: WEZAG GMBH WERKZEUGFABRIK, Stadtallendorf (DE)

( * ) Notice: Subject to any disclaimer, the term of this patent is extended or adjusted under 35 U.S.C. 154(b) by 2167 days.

(21) Appl. No.: 13/965,422

(22) Filed: Aug. 13, 2013

(65) Prior Publication Data

US 2014/0047885 A1 Feb. 20, 2014

(30) Foreign Application Priority Data

Aug. 15, 2012 (DE) ..... 10 2012 107 467

(51) Int. Cl.

| | |
|---|---|
| ***H01R 43/048*** | (2006.01) |
| ***H01R 43/058*** | (2006.01) |
| ***B30B 15/02*** | (2006.01) |
| ***B30B 15/00*** | (2006.01) |

(52) U.S. Cl.

CPC ..... *H01R 43/0486* (2013.01); *B30B 15/0094* (2013.01); *B30B 15/026* (2013.01); *H01R 43/048* (2013.01); *H01R 43/0488* (2013.01); *H01R 43/058* (2013.01)

(58) Field of Classification Search

CPC ..... H01R 43/086; H01R 43/0488; H01R 43/058; H01R 43/048; H01R 43/0486; B30B 15/00; B30B 15/0094; B30B 15/026

See application file for complete search history.

(56) References Cited

U.S. PATENT DOCUMENTS

| | | | | |
|---|---|---|---|---|
| 4,283,846 | A * | 8/1981 | Collier | H01R 43/04 72/427 |
| 5,727,409 | A | 3/1998 | Inoue et al. | |
| 5,937,505 | A | 8/1999 | Strong et al. | |
| 6,047,579 | A | 4/2000 | Schmitz | |
| 6,161,407 | A | 12/2000 | Meisser | |
| 6,487,885 | B2 | 12/2002 | Meisser et al. | |
| 6,612,147 | B2 * | 9/2003 | Beetz | H01R 43/0421 81/427.5 |

(Continued)

FOREIGN PATENT DOCUMENTS

| | | | |
|---|---|---|---|
| CH | 680406 A5 * | 8/1992 | H01R 43/058 |
| DE | 82 24 332 U1 | 11/1982 | |

(Continued)

OTHER PUBLICATIONS

European Search Report for co-pending, related EP Application No. 13179506.4, dated Nov. 25, 2013.

(Continued)

*Primary Examiner* — Pradeep C Battula

(74) *Attorney, Agent, or Firm* — Thomas | Horstemeyer, LLP

(57) ABSTRACT

The present invention relates to a set of interchangeable crimp units for a crimping machine. According to the invention each crimp unit comprises an integrated sensor for measuring a crimping force or a crimping displacement during the crimping process.

17 Claims, 22 Drawing Sheets

(56) References Cited

U.S. PATENT DOCUMENTS

| | | | | |
|---|---|---|---|---|
| 8,079,242 | B2 * | 12/2011 | Pacaud | H01R 43/0488 72/21.1 |
| 8,819,925 | B2 * | 9/2014 | Onuma | H01R 43/0486 29/753 |
| 9,331,447 | B2 * | 5/2016 | Charlton | H01R 43/0486 |
| 2003/0230131 | A1 * | 12/2003 | Bowles | B25B 27/10 72/416 |
| 2004/0007041 | A1 | 1/2004 | Imgrut et al. | |
| 2007/0101799 | A1 | 5/2007 | College | |
| 2008/0276678 | A1 * | 11/2008 | Pacaud | H01R 43/0488 72/21.4 |
| 2010/0010756 | A1 | 1/2010 | Derr et al. | |
| 2012/0124826 | A1 | 5/2012 | Onuma et al. | |

FOREIGN PATENT DOCUMENTS

| | | | |
|---|---|---|---|
| DE | 40 38 658 | A1 | 6/1991 |
| DE | 41 11 404 | A1 | 10/1992 |
| DE | 196 22 390 | A1 | 12/1996 |
| DE | 298 08 574 | U1 | 10/1998 |
| DE | 199 03 194 | A1 | 8/2000 |
| DE | 195 48 533 | C2 | 9/2000 |
| DE | 100 41 237 | B4 | 2/2006 |
| DE | 43 37 797 | B4 | 5/2007 |
| EP | 0 735 308 | A1 | 3/1996 |
| EP | 0 878 878 | A2 | 5/1998 |
| EP | 0 878 878 | B1 | 5/1998 |
| EP | 0 902 509 | A1 | 9/1998 |
| EP | 0 989 636 | B1 | 9/1999 |
| EP | 1 202 404 | A1 | 10/2001 |
| EP | 1 381 123 | A1 | 6/2003 |
| EP | 1 635 432 | A1 | 8/2005 |
| EP | 1 635 432 | B1 | 8/2005 |
| EP | 2 181 602 | A1 | 10/2009 |
| JP | H8-330048 | A | 12/1996 |
| JP | 4070705 | B2 | 1/2008 |
| JP | 4873476 | B2 | 12/2011 |
| TW | 364452 | | 7/1999 |
| TW | 1220113 | | 2/2005 |
| TW | 1315228 | | 3/2009 |
| WO | 2007/067507 | A1 | 6/2007 |

OTHER PUBLICATIONS

Taiwanese Search Report in co-pending, related TW Application No. 201411973, dated Dec. 8, 2016.

* cited by examiner

SET OF INTERCHANGEABLE CRIMP UNITS

CROSS REFERENCE TO RELATED APPLICATIONS

This application claims priority to co-pending German Patent Application No. DE 10 2012 107 467.4 entitled "Wechseladapter für eine Crimpmaschine", filed Aug. 15, 2012.

FIELD OF THE INVENTION

The present invention generally relates to a set of interchangeable crimp units for crimping machines. The crimp units are each used for crimping a work piece, in particular for crimping a plug with at least one cable. Furthermore, the present invention relates to a crimping machine with a set of interchangeable crimp units.

BACKGROUND OF THE INVENTION

DE 199 03 194 A1 discloses that during the crimping process of a work piece the crimping force depends on a plurality of factors, e.g. of the material, the cross section or geometry of a cable, the number of single wires in a cable, the distribution of single wires along the cross section and the surface of the single wires. Furthermore, the crimping force might depend on the electrical contact element or plug being crimped with the cable. The crimping force might furthermore depend on tolerances of the material thickness of the contact element, the hardness of the contact element, the composition of the contact element, the build-up of a groove indentation, the build-up of a face or transitional regions of the plug, the surface properties of the crimped surfaces, the presence of a lubricant at the crimped surfaces, the length of the crimping region and/or the length of rolled plastically deformed regions of the plug. The crimping force is also influenced by the shape of the die, the die profile, the die surface, the velocity of deformation and the like. Finally, the crimping force might also depend on operating or environmental conditions, on the used actuators, on the mechanical chain or drive mechanism for actuating the dies, on wear, on play of guidances, on external shocks, on contaminations, on missarrangements or on faulty components, temperatures and the like.

On the basis of measuring the crimping force it is possible to evaluate the crimping process. For a simple non-limiting example for the crimping process of a plug with a cable having 19 strands the predetermined maximum of the crimping force (or a tolerance region of this maximum) might be well known. If some of the strands are missing in the crimped cross section of the cable this leads to a deviation of the crimping force from the predetermined tolerance region of the maximum of the crimping force. For an evaluation of the crimping process it is possible to evaluate discrete values of the crimping force, in particular by evaluating minima and/or maxima of the crimping force curve or by sensing time intervals or crimping displacement curves between the minimum and the maximum), or by evaluating changes of the crimping force, of the velocity of a change of the crimping force and the like. The result of any such evaluation might be used for automatically sorting out crimped work pieces being produced by a faulty crimping process. Furthermore, it is possible to document the crimping force and/or the crimping displacement for some or each crimping process. Such documentation might be used e.g. in the case of an airplane crash for proving that the crimp of a plug with a cable in the airplane was produced according to the rules.

For sensing a crimping force during a crimping process DE 195 48 533 C2 discloses monitoring the current of an electric actuator used for producing the crimping force. In case that the current is larger (or smaller) than a predetermined current this might be taken as an indicator that the crimping process has not been performed according to the rules. Furthermore, DE 195 48 533 C2 discloses sensing the crimping displacement by a sensor during the crimping process. The measured crimping displacement is transferred to a control unit. The control unit evaluates the crimping process on the basis of the measured crimping displacement.

It is also known to integrate a force sensor into the force flow between a crimping unit and an anvil or a punch of a crimping machine, see DE 196 22 390 A1 and EP 2 181 602 A1.

According to EP 0 902 509 A1 a motor drives an eccenter drive via a transmission. The eccenter drive produces a vertical movement of a tool holder with a force sensor. In a calibration process for the force sensor the tool holder is coupled with a crimp simulator with an integrated second force sensor used during the calibration process. It is suggested to use a comparatively expensive sensor, in particular a quartz crystal force sensor for the second force sensor. EP 0 902 509 A1 also discloses an evaluation of the crimping force curve for evaluating the crimping process and for generating failure indications.

According to DE 43 37 797 B4 a force sensor is integrated into an anvil or punch, wherein the force sensor is interposed between a tool holder and a drive element. The force sensor comprises an upper surface and a lower surface. The upper surface is actuated by the drive element whereas the lower surface transfers the crimping force to the tool holder. The force sensor is located in a recess defined by both the tool holder and the drive element. The sensor comprises two piezo discs and an interposed disc electrode. The measurement signal of the sensor is transferred to a control unit.

EP 1 381 123 A1 discloses a tool receiver provided at the crimping machine. The tool receiver is moved by a drive in vertical direction. An upper tool is received and locked in the tool receiver. The tool receiver comprises a crimping force sensor unit having a housing. In the force flow between a bottom and a cover of the housing four force sensors are interposed in mechanically parallel arrangement. The four force sensors are located in a common plane having an orientation transverse to the crimping axis.

According to DE 40 38 658 A1 and EP 0 989 636 B1 a lower die half of a crimping machine is supported by a plate like support, a base plate, a mounting plate and a mount. A crimping force cell built by a piezo element is integrated into the mounting plate.

According to DE 41 11 404 A1 a plate like anvil is supported by a plurality of pressure sensors located in mechanically parallel arrangement in a common horizontal plane. The pressure sensors are built by piezo elements embedded into a damping cushion built by silicone.

DE 100 41 237 B4 discloses a crimping machine which is built with an anvil, a base plate, a receiving plate, a force sensor, a guiding element and a pressure bolt being guided in the guiding element. Guiding element, force sensor, receiving plate and base plate are screwed to one single unit.

EP 0 878 878 A2 discloses an adapter for measuring a crimping force. The adapter is integrated into the force flow of the crimping force with two force sensors located in mechanically parallel arrangement.

WO 2007/067507 A1 discloses a crimping machine wherein the dies build a component of the crimp unit. The crimp unit is exchangeable for being able to crimp work pieces of different sizes or types or in order to replace a damaged crimp unit. The crimp units are equipped with a storage unit and/or a control unit. The control unit and the storage unit are used for storing characteristic data of the crimp unit, the dies, the crimping displacements and for the types of work pieces crimped by this crimp unit. For the use of one crimp unit the stored data is read out and processed by a control unit of the crimping machine. WO 2007/067507 A1 also mentions a control of the crimping process without further specification if this control strategy bases upon measurements of the crimping displacement or bases upon the crimping force. In any case the measurement of the crimping displacement or the crimping force seems to be done externally from the crimp unit. Furthermore, the crimping machine comprises a feeding device for automatically feeding plugs to the crimp unit in a controlled fashion. The feeding device successively and automatically supplies a plurality of work pieces to the crimp unit. The movement of the work pieces along the feeding device is measured by a position sensor. It is possible that the feeding device is located spaced from or adjacent the crimp unit or coupled with the crimp unit.

Also U.S. Pat. No. 6,047,579 suggests storing characteristic data in a storage unit associated with a die. The stored data is wirelessly transmitted from the die to the crimping machine.

DE 298 08 574 U1 discloses a load cell designated for a crimping machine. The load cell is located laterally from the crimping dies. The load cell is built with force sensors being located between two plates.

DE 82 24 332 U1 discloses a protective housing of a crimping machine. In order to increase the operational safety after inserting the work piece into the dies the working stroke of the crimping machine is only admitted if the protective housing is closed. The protective housing is built by a transparent plastic material. The protective housing has an opening at its front wall for inserting the work piece. Also EP 0 735 308 A1 discloses a protective cover made of a transparent plastic material.

EP 1 635 432 A1 discloses die holders being guided against each other by guiding rods. The dies held by the die holders have a plurality of nests of differing geometries located one besides another. The crimping process according to EP 1 635 432 A1 is controlled on the basis of signals of crimping force sensors.

OBJECT OF THE INVENTION

It is an object of the invention to disclose a crimping machine or components of a crimping machine providing the option of measuring a crimping force and/or a crimping displacement.

Furthermore, it is an object of the invention to provide a crimping machine or components of a crimping machine with a plurality of uses and/or for different types of work pieces and the like.

Another object of the present invention is to increase the precision of sensing of a crimping force or crimping displacement.

The present invention also eases the assembly and disassembly process for adapting the crimping machine for different purposes.

SUMMARY OF THE INVENTION

The above cited prior art is based on the established concept that a sensor should be a fixed component of the crimping machine wherein the sensor is not exchangeably integrated into the actuation mechanism of the crimping machine. Also the electrical connection of the sensor for transferring the measurement signals and for the supply of electrical energy is a fixed part of the crimping machine. Any adaptation of the crimping machine to differing crimping processes (e.g. for different tools, for different types of work pieces or geometries of work pieces) for these embodiments requires a change of the construction of the crimping machine itself.

Differing from this established prejudice the invention for the first time suggests the use of a set of interchangeable crimp units for a crimping machine wherein each crimp unit comprises a pair of die holders. Dies held by these die holders might differ with respect to the number of nests, the nest contours, the extension along the crimping axis and the like. By use of the set of crimp units it is possible to use one and the same crimping machine in a multifunctional way by simple exchange of one crimp unit of the set with a different crimp unit of the set.

The die holders each comprise a coupling region for interchangeable coupling the crimp unit with the crimping machine. It is possible that the set of crimp units comprises crimp units with differing coupling regions for coupling the crimp units with different crimping machines. Furthermore, it is possible to use different crimp units with one and the same crimping machine wherein the different crimp units differ with respect to their sizes, the integrated sensor, the holding device and/or the crimping contour. It is also possible that a plurality of crimp units are identical for providing the option to replace a damaged crimp unit by a new crimp unit.

The invention includes integrating a sensor into each of the crimp units of the set. The sensor measures a force correlating with the crimping force and/or a crimping displacement. Accordingly, the inventive approach leaves the established route of the skilled person that the sensor has to be a fixed component of the crimping machine. Instead the invention accepts that the plurality of crimp units designated for one and the same crimping machine or differing crimping machines are each equipped with their own sensor. For the crimping machine according to the prior art a damaged sensor requires a reconstruction and repair of the crimping machine itself leading to outage time. For the inventive embodiment a damage of a sensor might be encountered by a replacement of the crimp unit with the damaged sensor by a new crimp unit.

It is also possible that differing crimp units are equipped with sensors having different measurement sensitivities. In case that according to the prior art a fixed sensor is integrated into the crimping machine, this fixed sensor has to be able to measure and support the maximum of the crimp force for any possible crimping process. Taking the limited resolution of a sensor and of the processing of the sensor signal, the measurement precision reduces when using the crimping machine for a crimping process with a smaller maximum of the crimping force. For the inventive crimp units, the crimp units might have sensors of different measurement regions or sensitivities. Accordingly, for differing crimping processes, individual crimp units might be chosen wherein the measurement region fits the maximum of the expected crimping force leading to a large precision and high resolution of the measured crimping force.

Furthermore, according to the invention, it is possible to locate the sensor in the crimp unit close to the dies. Longer transfer paths between the dies and the sensor according to the prior art deteriorate the measurement precision and increase the influence of errors. For the integration of the sensor into the crimp unit there are a lot of different options. According to a non-limiting example the sensor might be integrated into one of the die holders. Furthermore, it is possible that the sensor is located parallel to the force flow of the die holders during the crimping process. It is possible that the sensor is held or contacted by both of the two die holders. Furthermore, it is possible that the sensor is held between two parts of one die holder. Furthermore, it is possible that a die holder comprises a recess wherein the sensor is located. Any deformation of the die holder results in a bias of the sensor with a force which correlates with the crimping force. For another embodiment of the invention, the sensor is located in a coupling region of the crimp unit with the crimping machine. In case that the supporting surfaces of the sensor are integrated into the crimp unit and not freely accessible, it is possible that the crimp unit builds a protection of the sensor in disassembled state of the crimp unit.

For another embodiment of the invention, the crimp unit is equipped with a protective cover. The protective cover provides at least partially a cover of the parts of the crimp unit being moved during the crimping process. Furthermore, the protective cover might serve for protecting the components of the crimp unit against damages or contaminations, in particular when the crimp unit is not assembled with the crimping machine or during the storage of the crimp unit or during the transportation process.

The protective cover might have any shape and size and might be produced from any material or materials. For a preferred embodiment of the invention, the protective cover is at least partially built by a transparent or translucent material, e.g. acrylic glass. This embodiment has the advantage that it is possible to optically monitor the insertion process of the work piece into the dies and/or to monitor the process of replacing a crimp unit or of replacing the dies. Furthermore, it is possible that by means of the transparency of the protective cover the operator is able to optically inspect or monitor the crimping process itself.

For another embodiment of the invention, the die holders of the crimp units are held at each other in a loss-proof fashion. This might be done by a holding device that generally does not block a relative degree of freedom of the die holders in the crimping direction. However, it is also possible that the relative degree of freedom between the die holders is blocked in an unassembled state of a crimping unit, whereas with the assembly of the crimp unit with the crimping machine, the blocking of the relative degree of freedom is automatically released.

Any suitable means might be used for guiding the two die holders. For a preferred embodiment of the invention, the die holders are directly guided against each other. For a very simple guidance at least one guiding bolt or pin is used which is held by one of the die holders or which are held by one or each of the die holders. The guiding bolt or pin is guided in a guiding recess of the other die holder.

It is also possible to use two guiding bolts for additionally blocking a relative rotational degree of freedom of the die holders around the crimping axis. For a preferred embodiment, the two guiding bolts are located laterally on different sides from the crimping axis providing a compact design and a stiff guidance. It is possible that the guidance by at least one guiding bolt is permanently present for any distance of the die holders. However, it is also possible that at least one guiding bolt only enters into the respective guiding recess at the end of the crimping stroke. In the case of using two guiding bolts, these guiding bolts might have different lengths. During the crimping process, the longer guiding pin of that two guiding pins enters into a respective guiding recess before the shorter guiding pin of said two guiding pins enters into its respective guiding recess.

The sensor might be located at any location of the crimp unit, in particular in one of the die holders. For a preferred embodiment of the invention the sensor is located centrally when seen along the crimping axis. This embodiment might lead to a symmetrical bias of the sensor. Furthermore, the central arrangement of the sensor might provide a high sensitivity of the sensor. Furthermore, the central arrangement of the sensor at least reduces any asymmetric normal forces or bending moments acting upon the sensor.

The die holders might be designed and configured for holding dies having only one nest or for holding dies having a plurality of nests located one besides another. In this case one and the same crimp unit and one and the same die might be used for crimping different work pieces with differing crimping contours and/or cross sections.

For a preferred embodiment, the crimp units comprise a releasable interface or a releasable plug. The interface or plug serves for supplying electrical energy to the sensor and/or for transmitting an output signal of the sensor to a processing unit of the crimping machine. When assembling a crimp unit with a crimping machine the plug or interface is used for the electrical coupling between crimp unit and crimping machine. A replacement of a crimp unit by another crimp unit only requires an exchange of the interface or plug.

It is possible that the crimping unit transfers an output signal of the sensor via the interface or the plug to a control unit located separately from the crimp unit, in particular a control unit building a fixed component of the crimping machine. For one embodiment of the invention also a control unit might be integrated into the crimp unit. In this case, the control unit is equipped with control logic for processing an output signal of the sensor. The processed output signal might then be transferred via the interface or the plug to an external control unit of the crimping machine.

There are a lot of options for processing the output signal of the sensor in a control unit integrated into the crimp unit. For a non-limiting example, it is possible to calibrate the crimp units at the manufacturer or at another place. The resulting calibration factors or calibration curves might be modeled or stored in the control unit (or in a storage unit which is also integrated into the crimp unit). During the use of the crimp unit in the crimping machine, the control unit integrated into the crimp units determines a modified output signal under consideration of the calibration factor or curve. Accordingly, the crimp unit supplies adapted or modified output signals wherein the modified signal might already consider manufacturing tolerances or the calibration factors.

The crimp units of one set might differ with respect to their coupling regions, their sensors, their die holders and/or plugs or interfaces. The set of crimp units might be offered by the manufacturer so that a customer is able to choose an appropriate crimp unit from the set of crimp units. However, it is also possible that a customer acquires the set of crimp units wherein the crimp units are designated for different uses, in particular for an operation of the crimping tool with different dies, sensors, work pieces and/or crimping machines.

For another embodiment of the invention, the crimp units of the set of crimp units are provided with unique interfaces or plugs. The unique interfaces or plugs provide the option of coupling differing crimp units without additional measures with the respective interfaces or plugs of the crimping machine.

For another embodiment of the invention, the different crimp units of one set comprise sensors having different measurement regions or sensitivities. For this embodiment, the customer is able to choose between different crimp units depending on the expected maximum of the crimp force during the crimping process.

Another inventive solution is given by a crimping machine equipped with a set of crimp units as specified above.

It is possible that a crimping machine according to the invention is provided with a control unit. The control unit is equipped with control logic. The control logic determines a crimping force and/or a crimping displacement under consideration of at least one calibration factor and/or at least one calibration curve. It is possible that the calibration factor and calibration curve is determined by a calibration process at the manufacturer. The calibration factor or calibration curve is stored by the manufacturer on the control unit or an associated storage unit. However, it is also possible that the calibration factor or calibration curve is determined by a calibration procedure performed by the customer, see also the crimp simulator used for a calibration process as described in EP 0 902 509 A1.

For another embodiment, the control unit chooses between a plurality of calibration factors or calibration curves for different crimp units, different dies and/or different work pieces for calculating the crimping force and/or the crimping displacement from the output signal of the sensor. It is also possible that the operator manually inputs the respective calibration factor or calibration curve. For another embodiment the operator inputs the used type of crimp unit or used type of die wherein in this case the calibration factor or calibration curve is automatically determined by the control unit from a file with a plurality of stored calibration factors or calibration curves or from a field of characteristic data. It is also possible that the used type of crimp unit is automatically sensed by scanning a label, wherein in this case the calibration factor and the calibration curve is automatically chosen from a plurality of calibration factors or calibration curves in dependence on the scanned label.

If a die forms a plurality of nests, the sensitivity of the sensor of the crimping force (so also the calibration factor or calibration curve) might be dependent on the nest which is used for the crimping process. For one embodiment of the invention, the control logic uses different calibration factors or calibration curves for different nests of the die for calculating the crimping force or crimping displacement from the output signal of the sensor. The used nest of the plurality of nests might be manually input or automatically detected.

For optimizing the control of the crimping process and the operation of the crimping machine the crimping machine might have an additional sensor for sensing the crimping displacement. For one embodiment, it is possible that a control unit determines a curve representing the crimping force depending on the crimping displacement. The additional sensor for sensing the crimping displacement might be located at any position of the crimping unit, the crimping machine or the actuating mechanism of the crimping machine.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
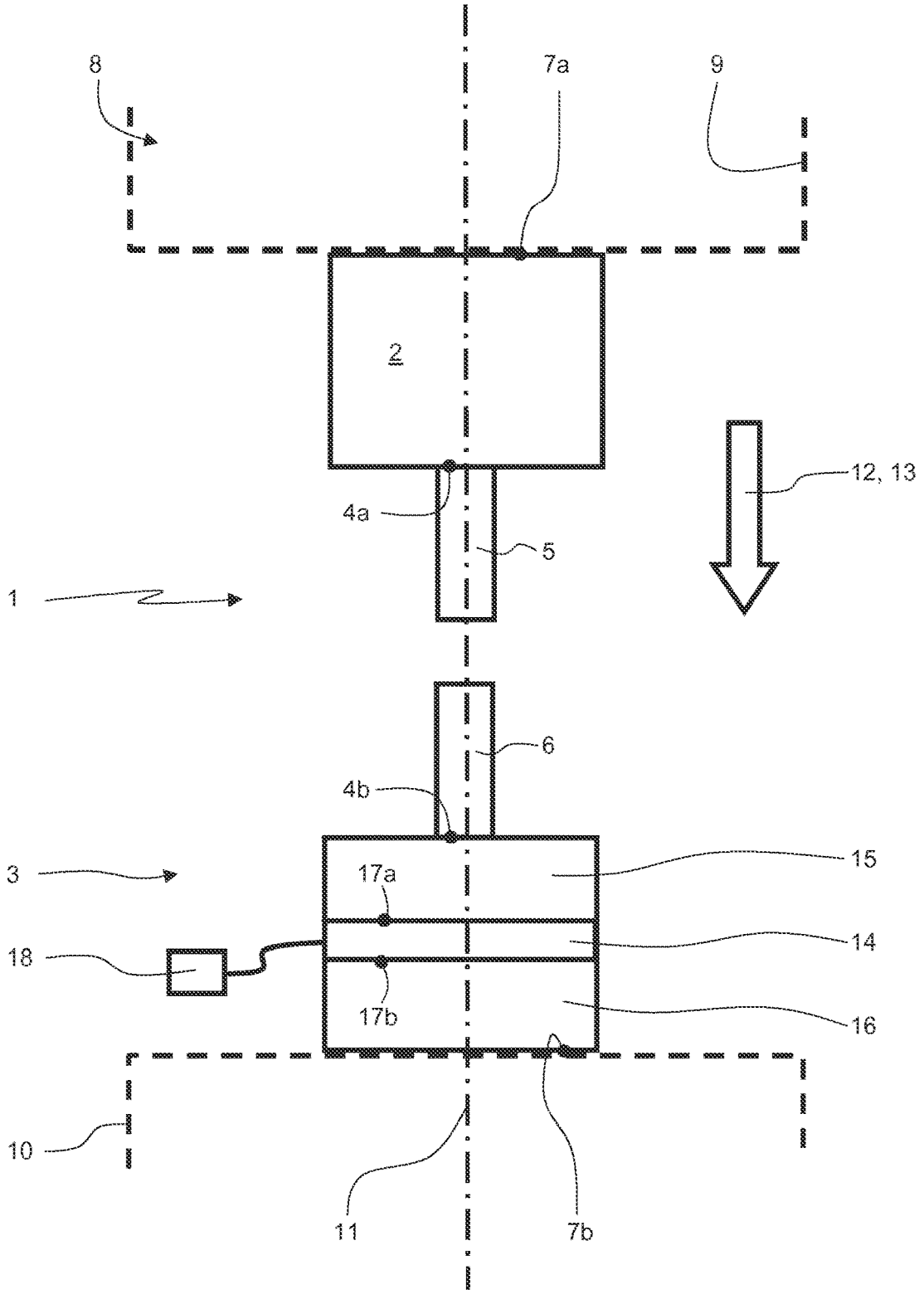
FIGS. 1 to 6 are rough schematic views of a crimp unit with an integrated sensor.

FIG. 1 is a rough schematic view of a crimp unit 1. The crimp unit 1 is built with die holders 2, 3 wherein one die holder 2 builds a kind of moved punch and the other die holder 3 builds a kind of fixed anvil. At the opposing faces the die holders 2, 3 each build receivers 4*a*, 4*b* designated for holding dies or die halves 5, 6 at the die holders 2, 3. Furthermore, the die holders 2, 3 comprise coupling regions located at the back faces or at the surfaces facing away from each other. The coupling regions 7*a*, 7*b* serve for coupling the die holders 2, 3 with a crimping machine 8. In the shown embodiment, only an upper part 9 and a lower part 10 (shown in dashed line) of the crimping machine 8 are shown. During the crimping process the upper part 9 is moved by any actuator (in particular a hydraulic or electric actuator) along a crimping path 12 along a crimping axis 11 towards the lower part 10. The actuator produces a crimping force 13. Along the crimping path 12 and by means of the crimping force 13 a work piece (in particular a plug with a cable located therein) is plastically deformed between the front surfaces of the die halves 5, 6.

A sensor 14 is integrated into the crimp unit 1. FIGS. 1 to 6 show different types of integrations of the sensor 14 into the crimp unit 1 in schematic views:

According to FIG. 1 the die holder 3 is built with die holder parts 15, 16. The sensor 14 is housed or supported between the die holder parts 15, 16. The sensor 14 comprises parallel biasing surfaces 17*a*, 17*b*. The biasing surfaces 17*a*, 17*b* are pressed against front faces of the die holder parts 15, 16 with the crimping force 13. The sensor 14 produces an output signal correlating with the crimping force 13. The output signal is transferred by a plug or an interface 18 to a control unit of the crimping machine 8. For the shown embodiment the sensor 14 is located in line in the force flow from the lower part 10 over the die holder part 16, the sensor 14, the die holder part 15, the die receiver 4*b* and the die half 6 to the work piece.

Figure 2:
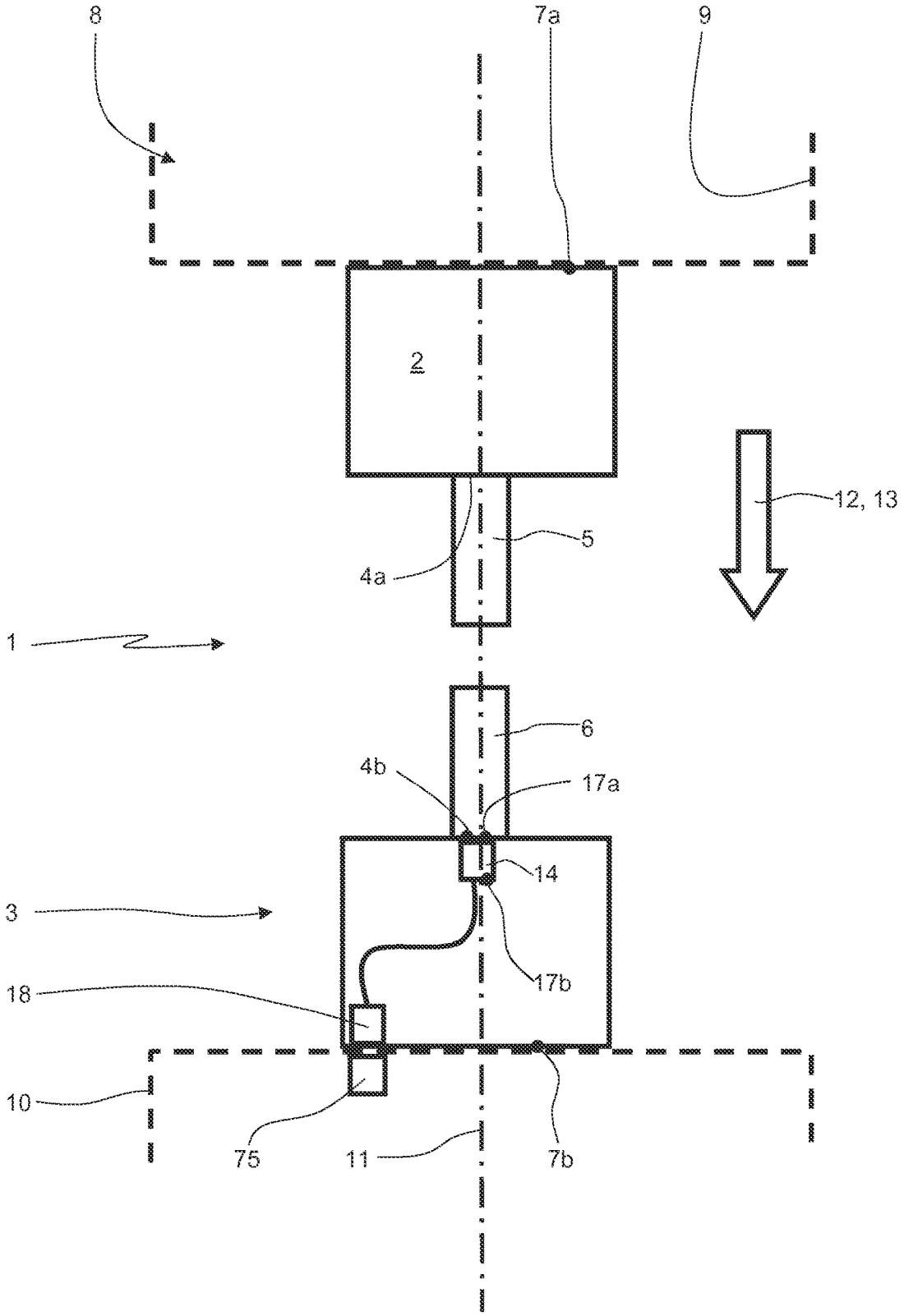

For the embodiment shown in FIG. 2 the sensor 14 is located in the region of the die receiver 4*b*. In this case a biasing surface 17*b* of the sensor 14 is supported at the die holder 3, whereas another biasing surface 17*a* (which is located in the region of the die receiver 4) is supported at the die half 6. Here, the sensor 14 is located in line between the die holder 3 and the die half 6. However, for a differing embodiment it is also possible that the die half 6 is (additionally to the support at the biasing surface 17*a*) also supported at an additional surface built by the die holder 3. This additional surface is located in the region of the die receiver 4*b*. The additional support provides a parallel force flow between the die half 6 and the die holder 3 for partially unloading the sensor 14.

Differing from the embodiment shown in FIG. 1 for the embodiment shown in FIG. 2 the output signal of the sensor 14 is transferred to the crimping machine 8 by a plug or interface 18 located in the coupling region 7*b*. With the connecting process between the lower part 10 and the die holder 3 the plug or interface 18 establishes an electric connection with a plug or interface 75 located at the lower part 10 for transferring the output signal of the sensor 14 (in FIGS. 3 to 6 for a simplification of the representation the cable associated with the sensor 14 as well as the plug or interface 18 are not shown).

Figure 3:
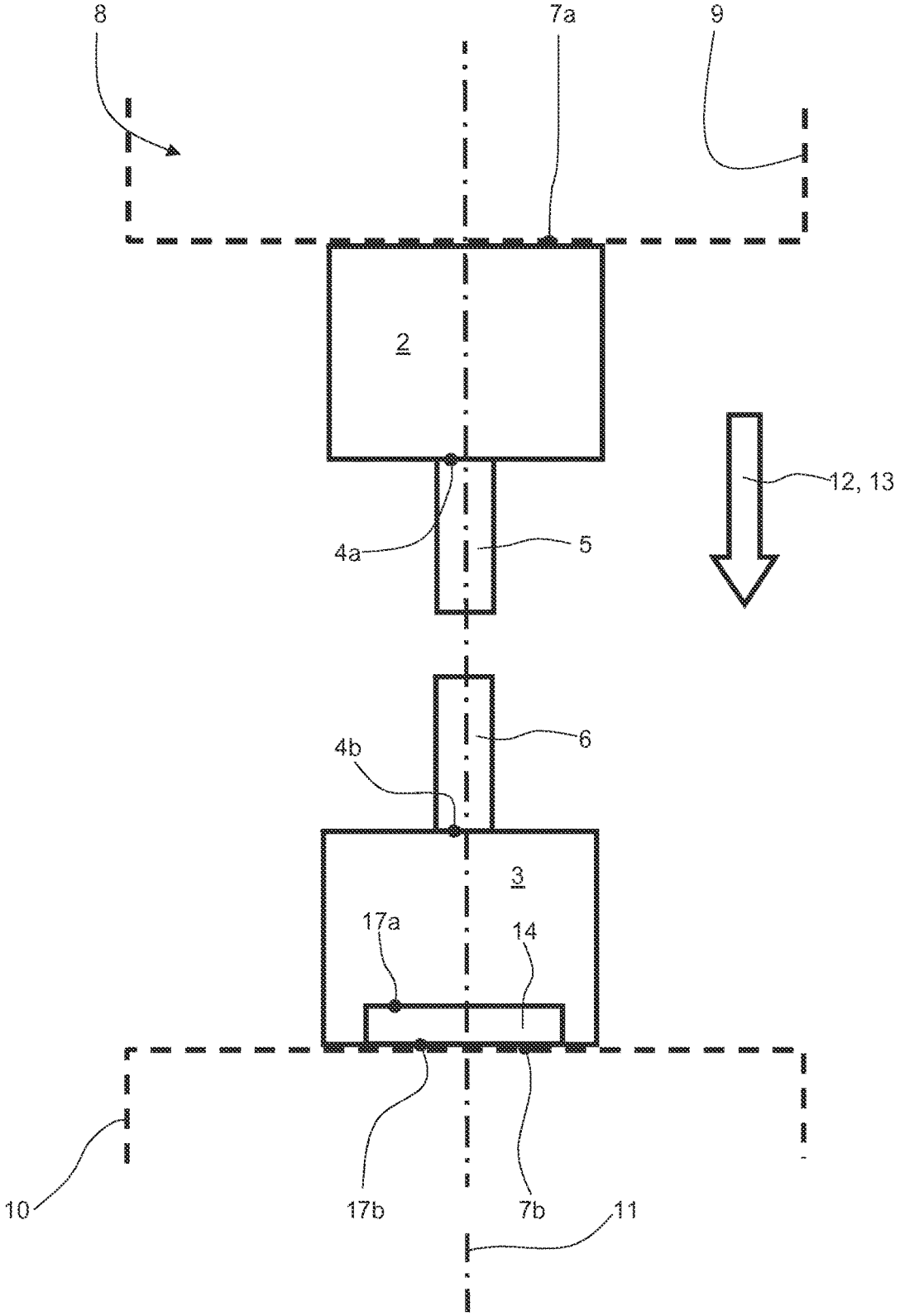

According to FIG. 3 the sensor 14 is located in the coupling region 7*b*. In this case a biasing surface 17*a* of the sensor 14 is supported at the die holder 3. The other biasing surface 17*b* is supported in the coupling region 7*b* at the lower part 10. Here, the force flow passes in line from the lower part 10 over the sensor 14 to the die holder 3. However, as shown schematically in FIG. 3 there might also be a parallel force flow via a path over the sensor 14 to additional contact surfaces between the die holder 3 and the lower part 10.

Figure 4:
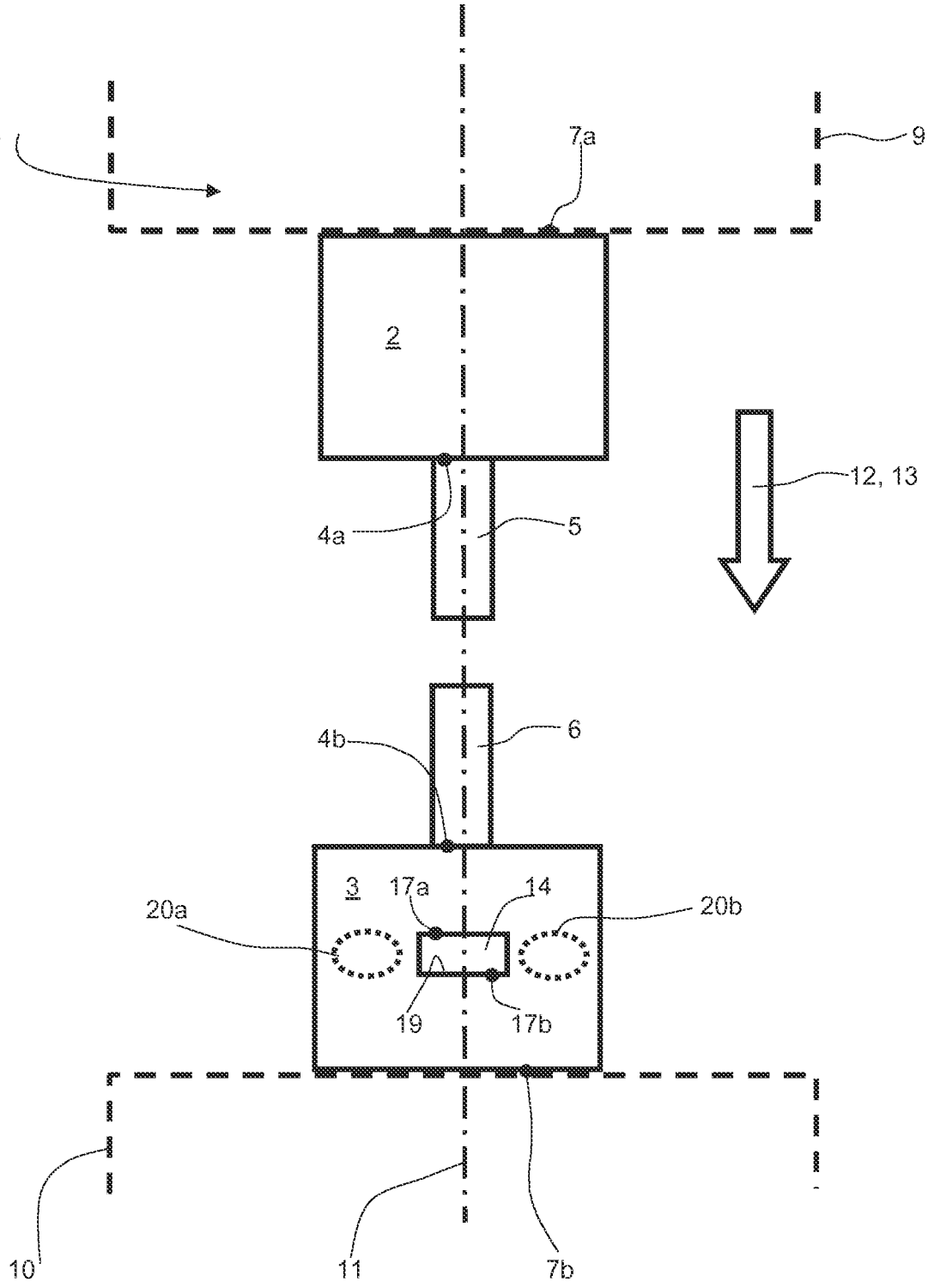

For the embodiment shown in FIG. 4 the die holder 3 comprises a recess 19. The sensor 14 is located in the recess 19. For this embodiment, the bias of the sensor 14 requires an elastic deformation of the die holder 3 due to the crimping force 13 in deformation regions 20*a*, 20*b*. The deformation regions 20*a*, 20*b* are preferably located laterally from the sensor 14. A component of the crimping force 13 biases the deformation regions 20*a*, 20*b*, whereas the other component of the crimping force 13 biases the sensor 14.

Figure 5:
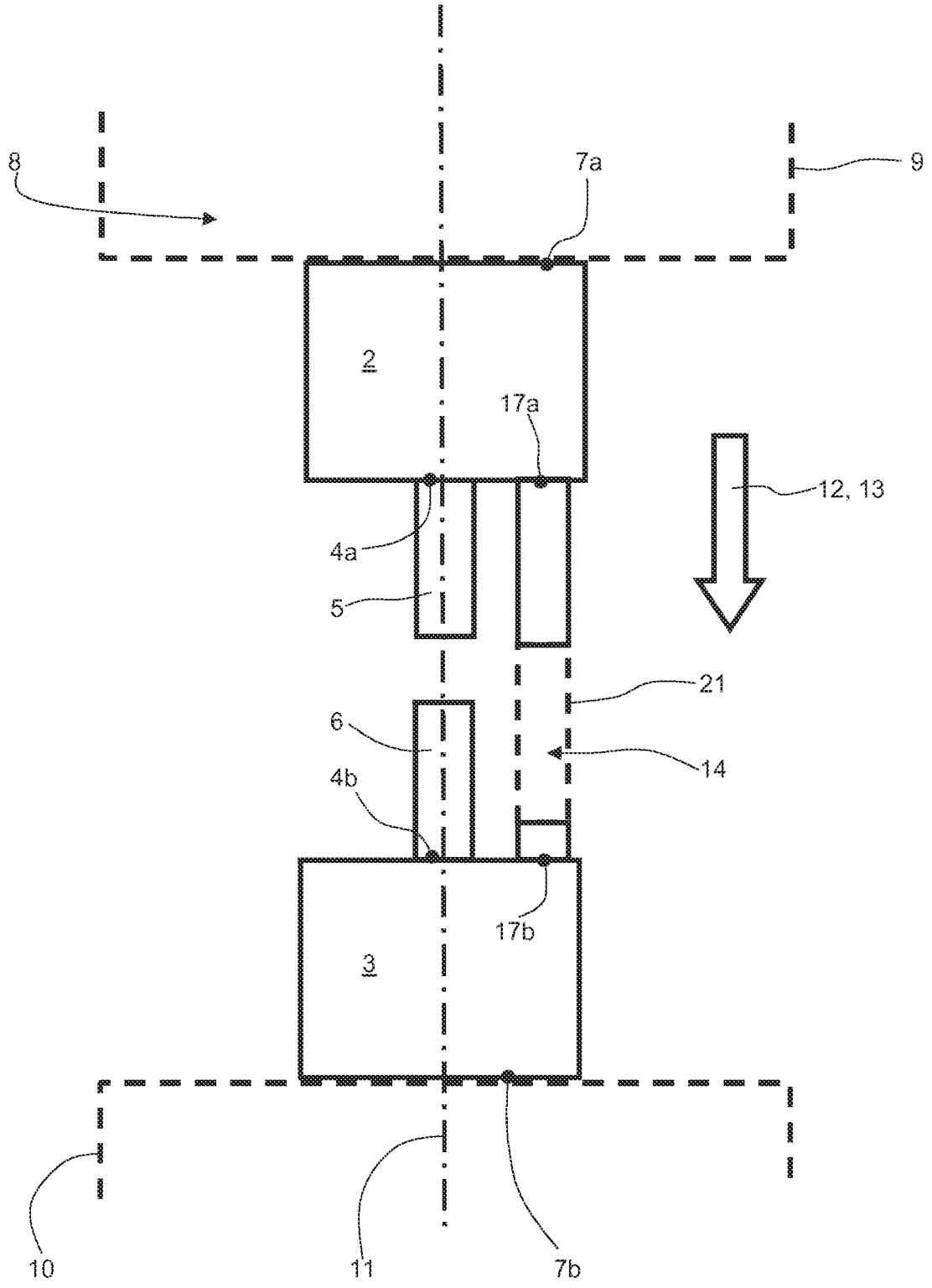

According to FIG. 5 the sensor is located parallel to the force flow between the die halves 5, 6. For this embodiment, the sensor 14 is both supported by the die holder 2 as well as by the die holder 3 with its biasing surfaces 17*a*, 17*b*. The biasing surfaces 17*a*, 17*b* might be biased in the region of the die receivers 4*a*, 4*b* or remote from the die receivers 4*a*, 4*b*. For this embodiment, the sensor 14 comprises a deformation region 21 for providing the crimping displacement 12. For the shown embodiment, the sensor 14 is biased over the whole crimping displacement 12. However, for a modified embodiment it is possible that the sensor is located with a kind of play between the die holders 2, 3 such that the sensor 14 is only biased at the end of the crimping path 12. In this case the sensor 14 is only in one direction fixed at one of the die holders 2, 3 having a spacing to the other die holder. For this embodiment, the sensor 14 establishes a contact with the other die holder 3, 2 after closing the spacing. However, it is also possible that a part of the sensor 14 is fixed at the die holder 2 whereas the other part of the sensor 14 is fixed at the die holder 3. The two parts of the sensors 14 interact with each other after overcoming the spacing.

Figure 6:
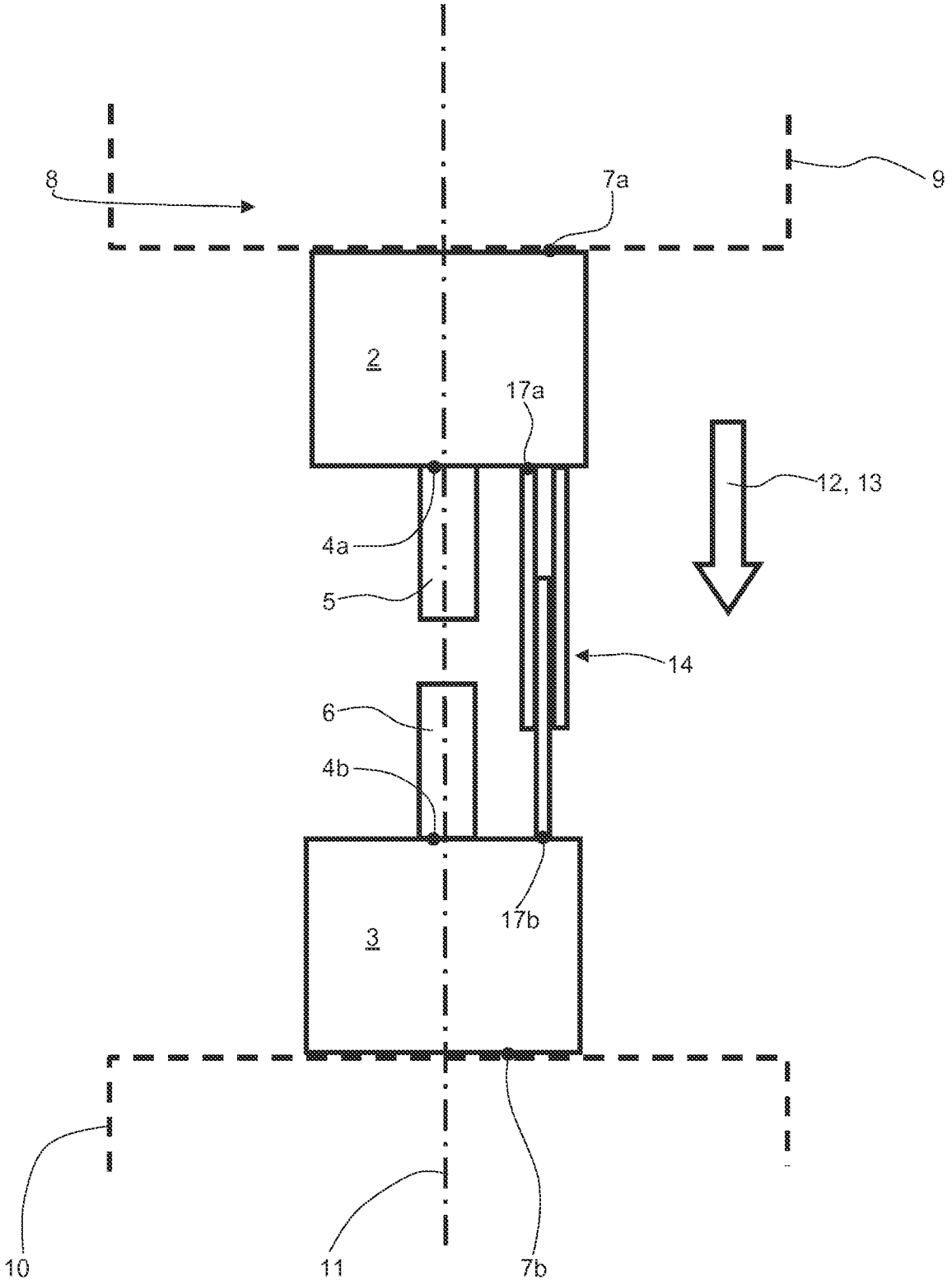

FIG. 6 schematically shows a sensor 14 being fixed both at the die holder 2 and at the die holder 3. The sensor 14 might be a force sensor of any type. However, it is also possible that according to FIG. 6 the sensor senses the relative movement of two sensor parts each being held by one of the die holders 2, 3 so that the sensor 14 measures the relative crimping displacement. For another embodiment, the crimp unit 1 comprises both a displacement sensor and a force sensor.

Figure 7:
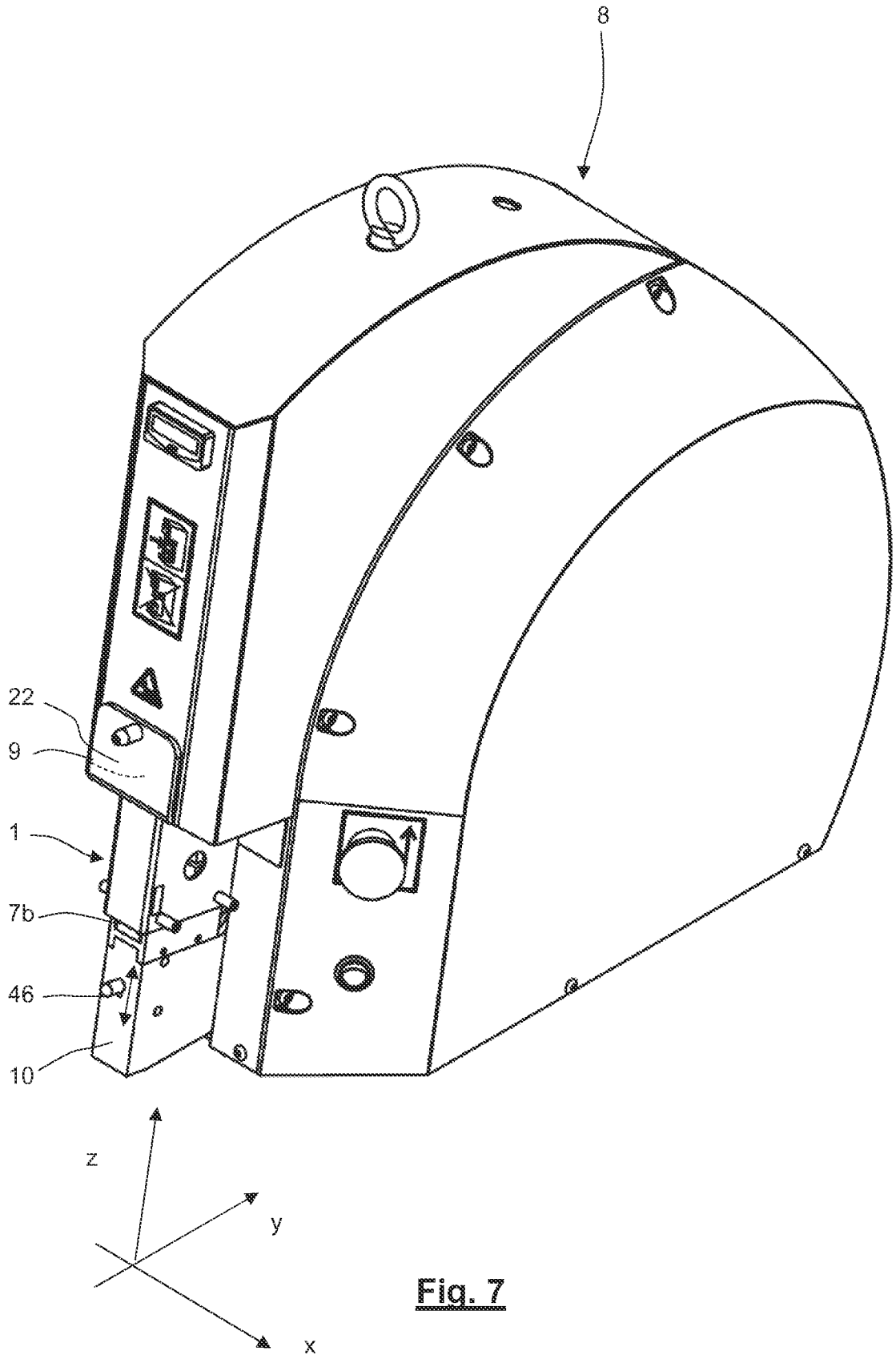
FIG. 7 is a three dimensional view of a crimping machine.

FIG. 7 more detailed shows a possible embodiment of a crimping machine 8. A crimp unit 1 is interposed between the lower part 10 and the (here covered) upper part 9. In the coordinate system in the following figures

- axis z denotes a crimping axis being slightly inclined relative to the vertical direction to the rear side,
- axis y denotes a longitudinal extension of the die halves 5, 6 and a direction for inserting die holders 2, 3 into the coupling regions 7*a*, 7*b* (see also the following description)
- axis x denotes a transverse axis of the die halves 5, 6 which in particular corresponds to the longitudinal axis of the plug and the cable when inserted into the crimp unit 1.

FIG. 7 shows the coupling region 7*b* at a front face. The coupling region 7*a* is covered by a cover plate 22 which in a closed state is held at the crimping machine 8 by a securing screw. In the shown state, the cover plate 22 blocks a movement of die holder 3 out of the coupling region 7*a*—a removal of die holder 3 from the crimping machine 8 is only possible when disassembling the cover plate 22.

Figure 8:
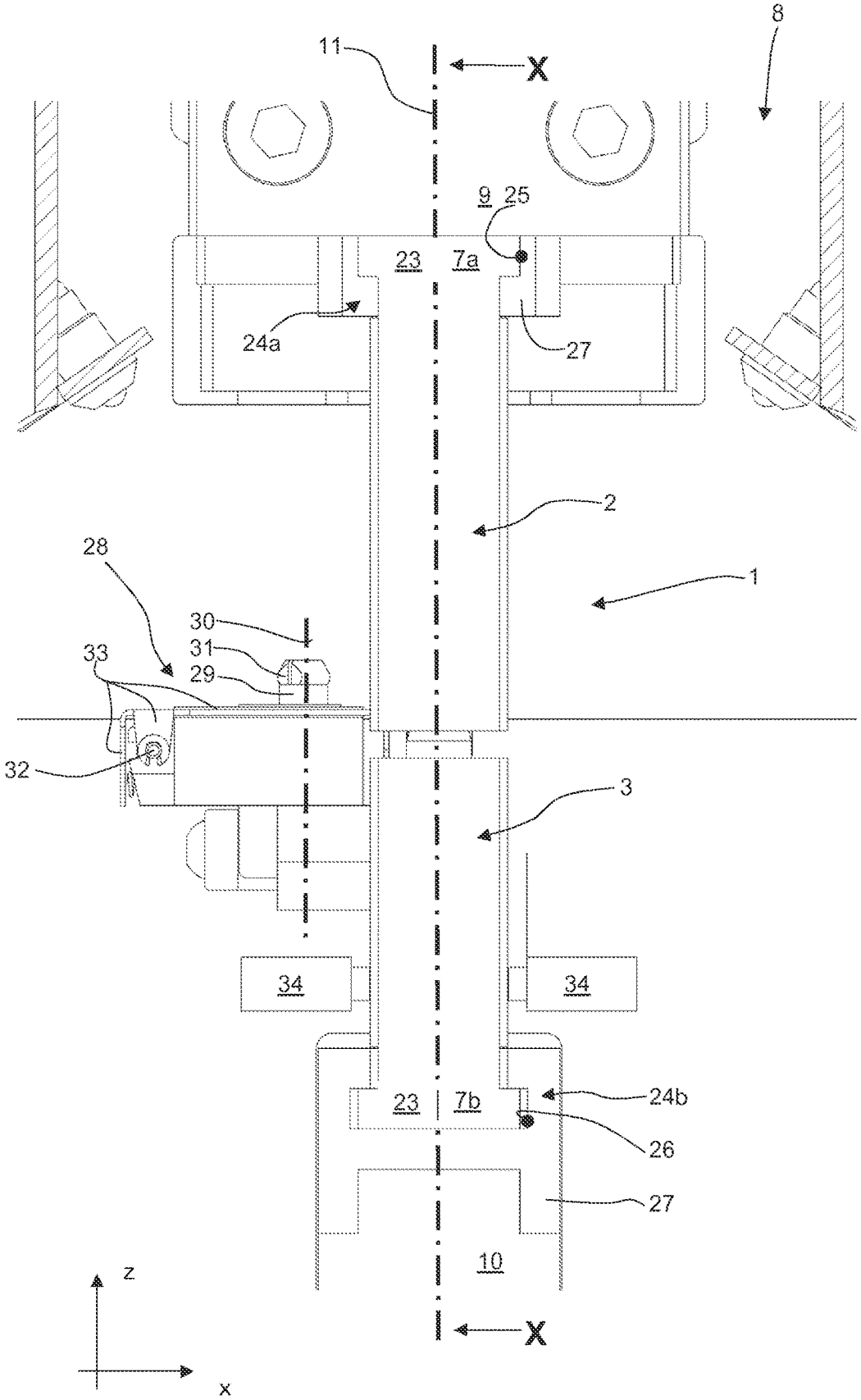
FIG. 8 is a detail of a crimping machine with a crimp unit in a partial sectional front view.

FIG. 8 shows the mounting of the crimp unit 1 by the die holders 2, 3 at the upper and lower parts 9, 10 of the crimping machine. According to FIG. 8 the coupling regions 7*a*, 7*b* of the die holders 2, 3 comprise T-shaped extension 23 cooperating with corresponding coupling regions 24*a*, 24*b* of the upper part 9 and the lower part 10. For the shown embodiment, the coupling regions 24*a*, 24*b* are built by T-shaped grooves 25, 26. The longitudinal axes of the T-shaped grooves 25, 26 have an orientation parallel to the y-axis. For the shown embodiment the T-shaped grooves are built by holding elements 27 being fixed at the base body of the upper and lower part 9, 10. In FIG. 8 also a locator 28 is shown. The locator 28 serves for introducing a work piece (in particular a plug with a cable) in a predetermined relative position and orientation between the die halves 5, 6 and/or for holding the work piece in this position and orientation before and/or during the crimping process. The locator 28 comprises a pivoting bolt 29 defining a pivoting axis 30. Furthermore, the locator 28 comprises a latching unit located in an upper end region of the pivoting bolt 29. Furthermore, the locator 28 comprises a holding unit 23 which is pivotable around a pivoting axis 32. The pivoting axis has an orientation parallel to the y-axis. A pivoting movement of the holding unit 33 biases a spring. For the shown embodiment the holding unit 33 is built by an angled holding metal sheet which serves for fixing the work piece at the locator 28.

Figure 9:
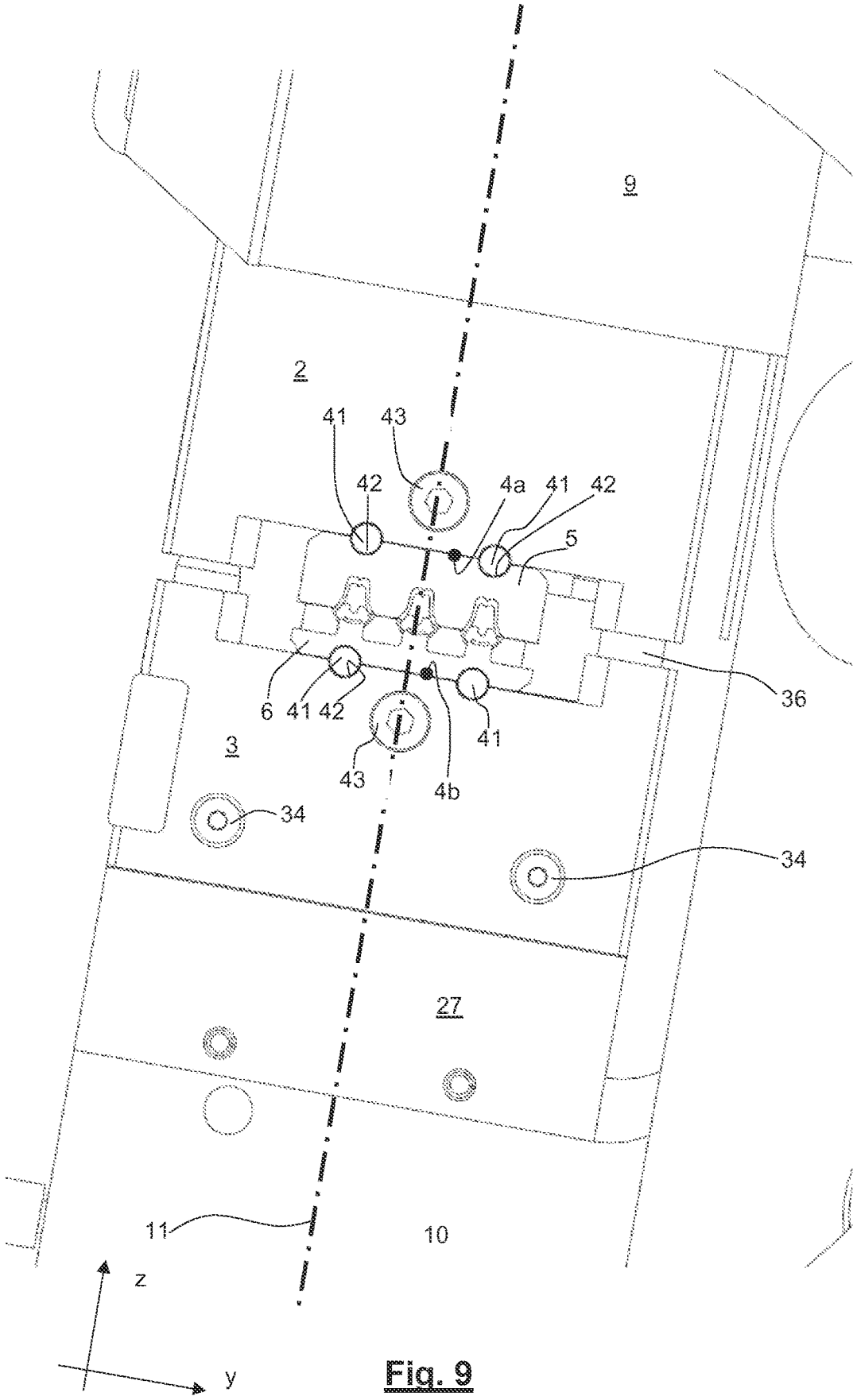
FIG. 9 is a detail of the crimping machine of FIG. 7 with a crimp unit in a side view (viewing direction opposite to x-axis).

FIGS. 8 and 9 show handling means 34 being fixed at the die holder 3. The handling means extend parallel to the x-axis. For the shown embodiment, the handling means 34 are built by rotatable bolts or sleeves. The handling means 34 serve for holding the crimp unit 1 or die holder 3 with the fingers of the operator. Furthermore, the handling means 34 might be used for guiding the crimp unit 1 during the coupling process via the coupling regions 7. According to FIG. 9 the die halves 5, 6 are held at the die receivers 4*a*, 4*b* of the die holders 2, 3. The die halves 5, 6 have a longitudinal extension parallel to the y-axis. Furthermore, FIG. 9 shows two guiding bolts 35, 36 located in both sides of the die halves 5, 6 and being held by die holder 3. The guiding bolts 35, 36 enter into guiding recesses 37, 38 of die holder 2 for providing a guidance for the die holders 2, 3 during the crimping process.

Figure 10:
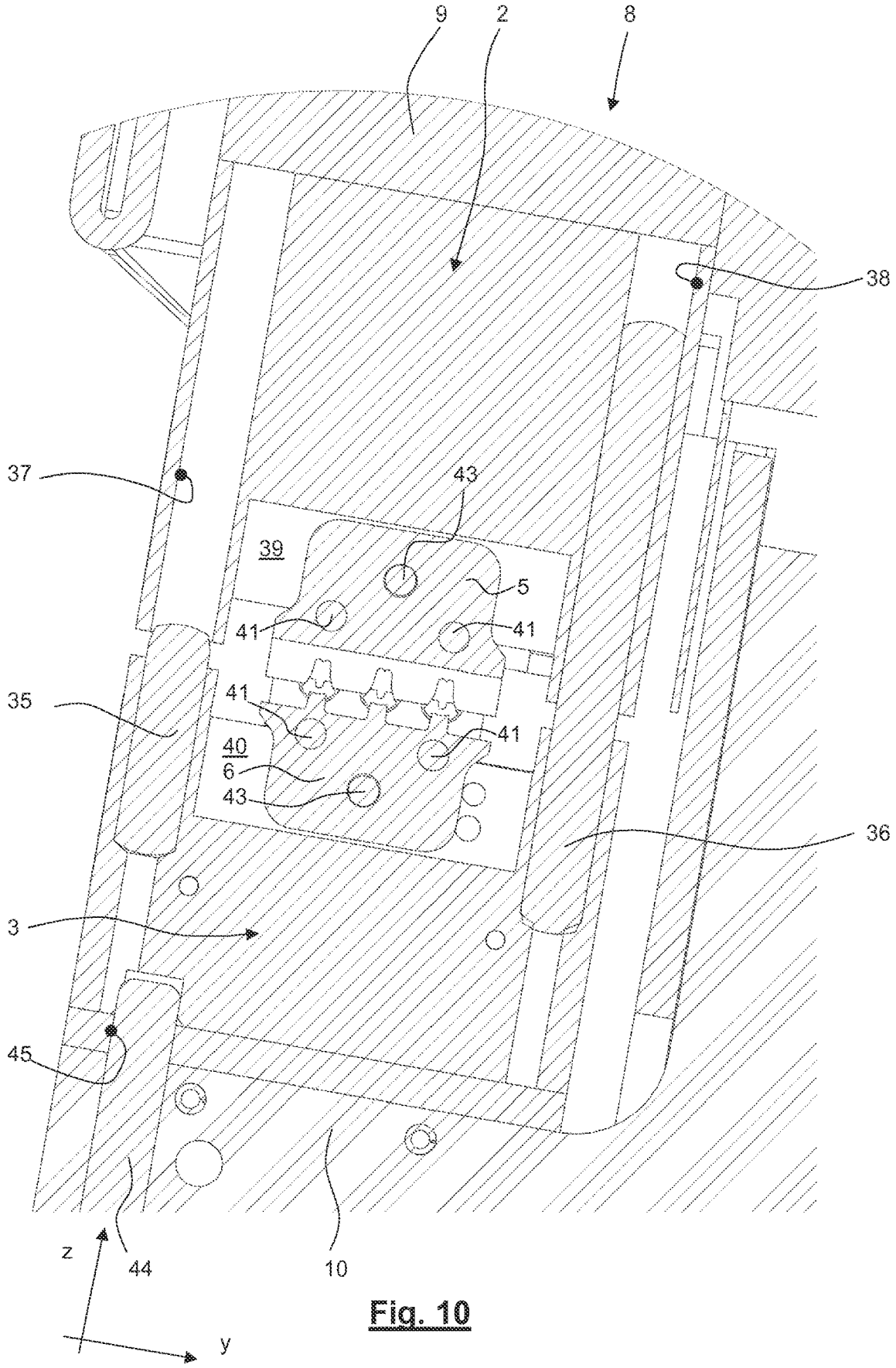
FIG. 10 is a sectional view x-x of a detail of the crimping machine with a crimp unit of FIG. 8.

As shown in the sectional view of FIG. 10 the guiding bolt 35 being located closer to the operator of the crimping machine 8 is shorter than the other guiding bolt 36. The guiding bolts 35, 36 are received with a close fit in corresponding bores of the die holder 3 wherein the bores have an orientation parallel to the z-axis. The die holder 2 comprises the guiding recesses 37, 38 wherein the guiding recesses 37, 38 are aligned with the guiding bolts 35, 36. The guiding recesses 37, 38 are here built by bores wherein the diameter of the bores builds a loose fit with the diameter of the guiding bolts 35, 36. Due to the different lengths of the guiding bolts 35, 36 the front guiding bolt 35 only enters into the related guiding recess at the end of the crimping process, in particular after finishing any empty stroke. If the die holders 2, 3 are wide opened, the guiding bolt 35 is located distant from the die holder 2. This distant location of the guiding bolt 35 from the die holder 2 provides a kind of window for the operator at the front side for inspecting the interior of the crimp unit 1 and for inspecting the die halves 5, 6 as well as for monitoring the insertion and positioning process of the plug and the cable into the die halves 5, 6.

FIGS. 9 and 10 show one example for the design of the coupling of the die halves 5, 6 with the die holders 2, 3 at the die receivers 4*a*, 4*b*. The die halves 5, 6 have a generally plate like design. The die halves 5, 6 are insertable into a corresponding slot, a recess or groove 39, 40 of the die holders 2, 3. Supporting and centering bolts 41 extend transverse to the plate like base body of the die halves 5, 6. The supporting and centering bolts 41 have an orientation parallel to the x-axis. In the sectional view of FIG. 10 the centering bolts 41 are located at the corners of a rectangle. Two of the supporting and centering bolts 41 are each located at the die holders 2, 3. The supporting and centering bolts 41 are positioned in half-shell shaped receivers 42 on both sides of the slots, grooves or recesses 39, 40 of the die receivers 4*a*, 4*b*. This design guarantees an exact positioning of the die halves 5, 6. On the other hand the supporting and centering bolts 41 serve for supporting the crimping forces 13 between the die halves 5, 6 and the die holders 2, 3. Additionally, the die halves 5, 6 are each fixed at the die holders 2, 3 by a screw 43. The screws 43 extend parallel to the x-axis. Furthermore, FIG. 10 shows a securing bolt 44 which is movable along the z-axis in a bore of the lower part 10. The securing bolt 44 is biased by a spring (not shown) into the state shown in FIG. 10. In this state the securing bolt 44 extends through a recess 45 of die holder 3 for building a positive lock that avoids that the die holder 3 exits in FIG. 10 to the left from the T-groove 26. Due to the coupling of the die holders 2, 3 by guiding bolts 35, 36 the securing bolt 44 indirectly also serves for securing the die holder 2. The die holder 2 is additionally secured by the cover plate 22 as described above. For removing the crimp unit 1 from the crimping machine 8 it is necessary to actuate the securing bolt 44 manually in downward direction which might be done by actuating the actuating means 46 as shown in FIG. 7.

For the shown embodiment of FIGS. 7 to 10 the coupling regions 7*a*, 7*b* are built by T-shaped extensions 23 and the recess 45 and contact surfaces of the die holder 2 with the cover plate 22. This design provides an exchangeable coupling of the crimp unit 1 with the crimping machine 8 as well as a fixation in the assembled state. The die receivers 4*a*, 4*b* of the crimp unit 1 are in the shown embodiment built by slots, recesses or grooves 39, 40, the receivers 42 and the bore or thread for the screw 43 for a releasable fixation of the die halves 5, 6 at the die holders 2, 3.

FIGS. 11 to 14 show a set of crimp units 1*a*, 1*b*, 1*c*, 1*d* as being offered and sold by the manufacturer or a company for the use of different die halves 5, 6 and/or for the coupling with different crimping machines 8. The crimp units 1 of FIGS. 11 to 14 have identical coupling regions 7*a*, 7*b* so that these crimp units 1 are designated for use in a particular crimping machine 8 or different crimping machines comprising corresponding coupling regions.

Figure 11:
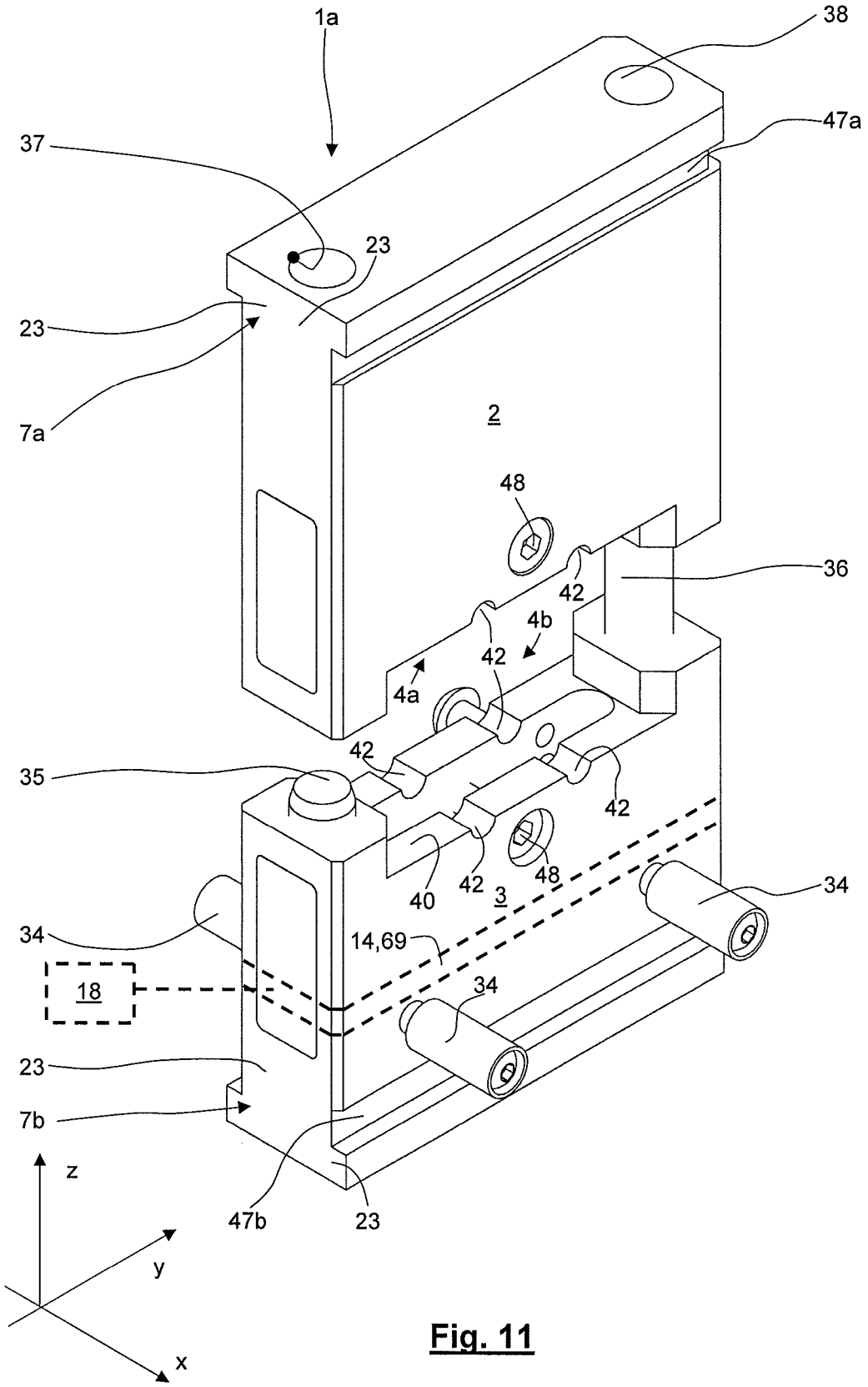
FIGS. 11 to 14 show different embodiments of crimp units without a protection cover in a three dimensional view.

As shown in FIG. 11 the coupling regions 7*a*, 7*b* comprise (additionally to the extensions 23) guiding grooves 47 being engaged by corresponding protrusions of the upper and lower parts 9, 10. FIG. 11 shows the crimp unit 1 according to the embodiment shown in FIGS. 8 to 10 wherein the die receivers 4*a*, 4*b* are built with the receiver 42 and a bore 48 for the screw 43.

Figure 12:
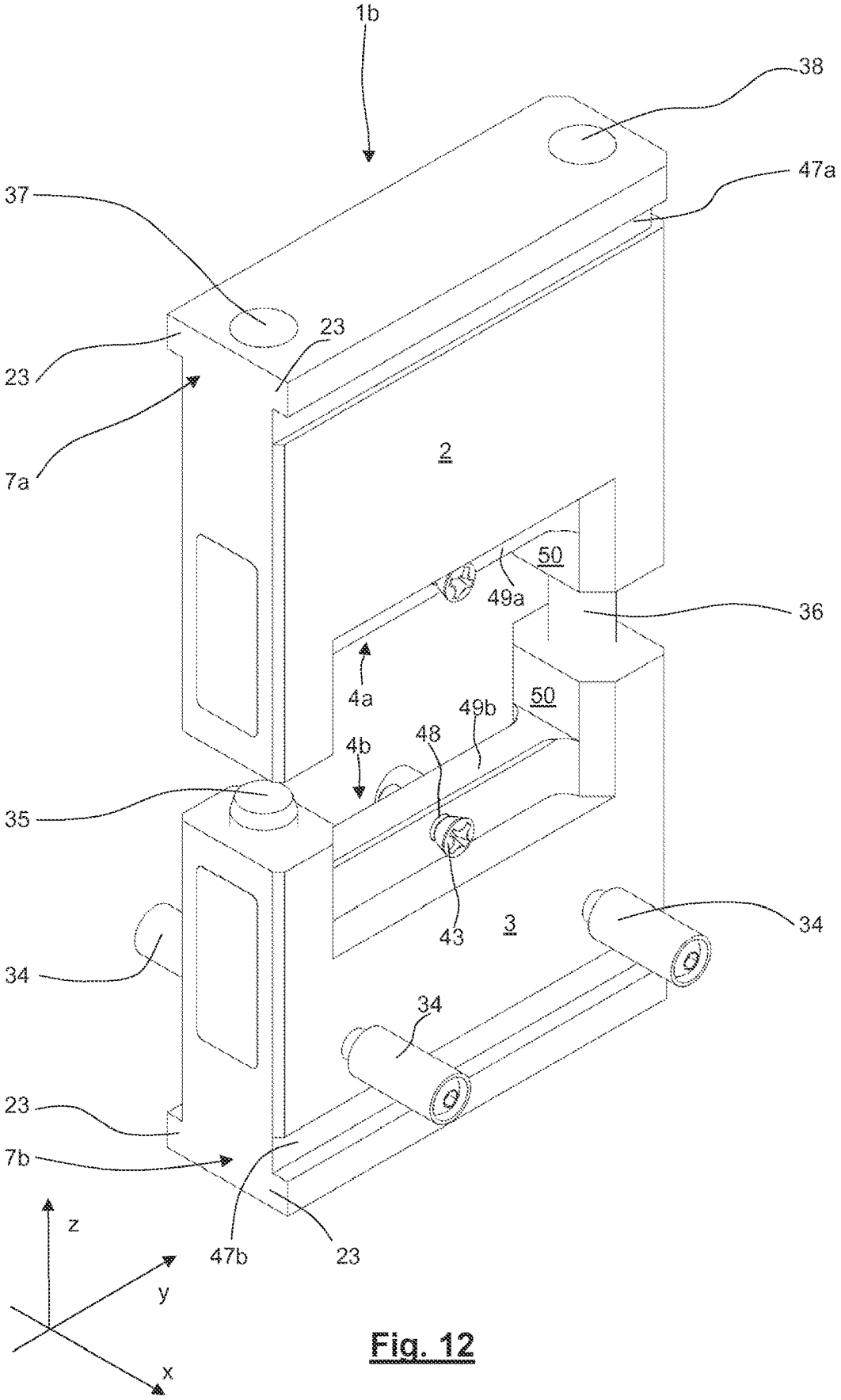

FIG. 12 shows a crimp unit 1*b* with a differing design of the die receiver 4*a*, 4*b*: Here, the die receivers 4*a*, 4*b* have a protrusion or rip 49 extending along the y-axis. The protrusion or rip 49 has a generally rectangular cross section in the y-z-plane. The rectangular cross section does not change along the y-axis. The die receivers 4*a*, 4*b* are designated for die halves 5, 6 having slots, grooves or recesses at the side facing towards the die receivers 4*a*, 4*b*. The slots, grooves or recesses have a cross section corresponding to the cross section of the protrusion or rip 49. For the assembled state of the die halves 5, 6 in the die receivers 4*a*, 4*b* the die halves 5, 6 embrace the protrusions or rips 49*a*, 49*b* in a U-like fashion. Additionally the protrusions or rips 49 comprise a transverse thread extending parallel to the x-axis. A mounting screw 43 is screwed into this transverse thread. Accordingly, the die receivers 4*a*, 4*b* are in this case built by the combination of the protrusions or rips 49 with the screws 43 or a bore or a thread for the screws 43. Additionally, the die halves 5, 6 might contact with their front surface at contact or guiding surfaces 50 of the die holders 2, 3 for guiding purposes.

Figure 13:
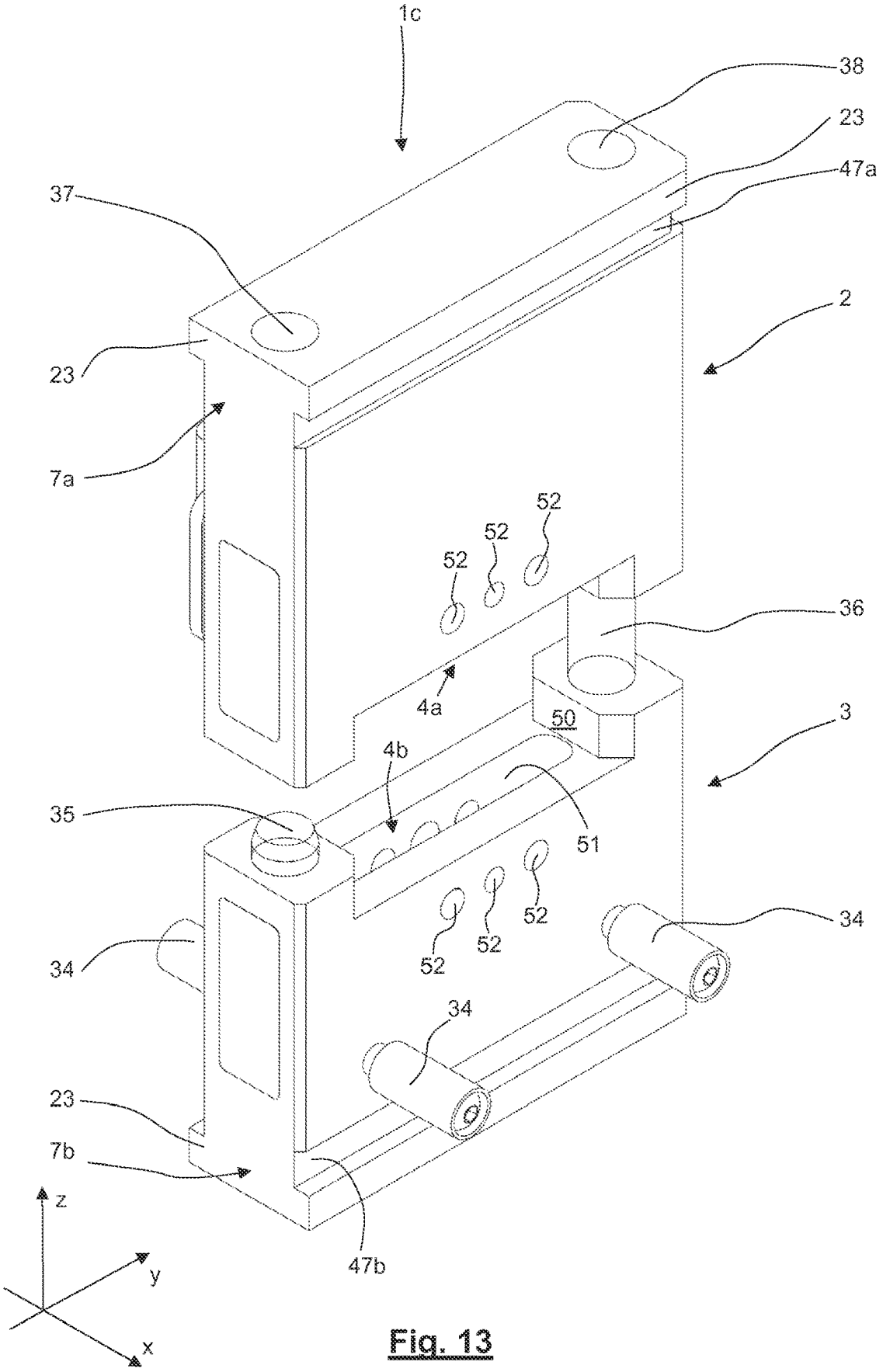

For the embodiment shown in FIG. 13 the die receivers 4*a*, 4*b* are built with slots, recesses or grooves 51 extending parallel to the y-axis. Protrusions or rips formed by the die halves 5, 6 enter into these slots, recesses or grooves 51. The die halves 5, 6 are supported at a step or contact surface at the upper surface of the die receivers 4*a*, 4*b*. It is also possible that the die halves 5, 6 have a plate-like design with a geometry appropriate for introducing the die halves 5, 6 into the slots 51. For a fixation of the die halves 5, 6 in the die receivers 4*a*, 4*b* the die receivers 4*a*, 4*b* comprise through bores 52 extending parallel to the y-axis. It is possible to insert a pin or screw into these through bores 52. The pin or screw also extends through a corresponding through bore of the die halves 5, 6. Accordingly, in the crimp unit 1*c* the die receivers 4*a*, 4*b* are built with the slots, grooves or recesses 51 and the through bores 52.

Figure 14:
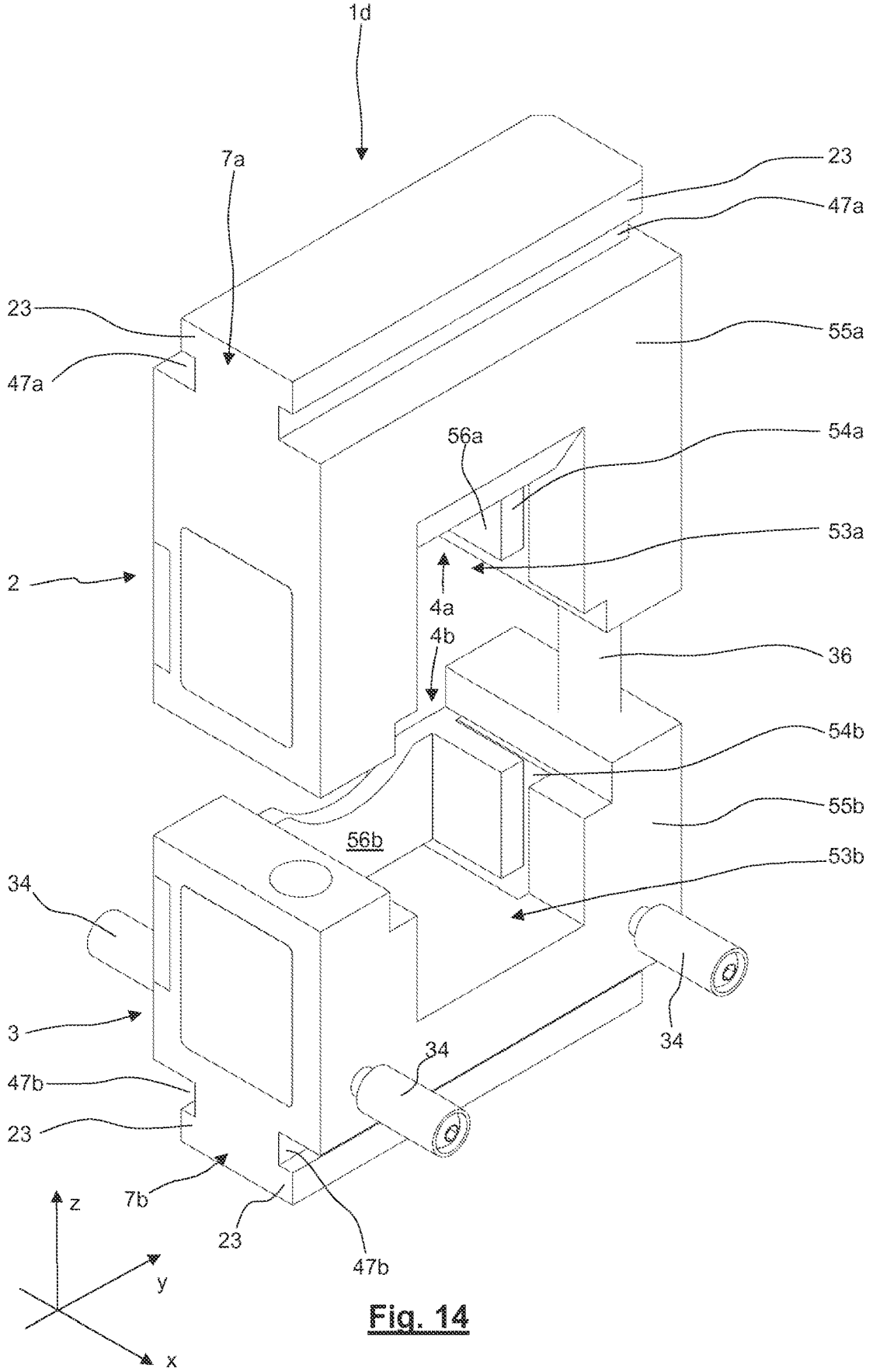

The crimp unit 1*d* according to FIG. 14 comprises significantly increased dimensions in the y-direction so that this crimp unit 1*d* might be used for holding die halves 5, 6 with increased dimensions. For the crimp unit 1*d* the die receivers 4*a*, 4*b* are in a first approximation built by a block-like receiving space 53. The receiving spaces 53 are each open in the direction of the x-axis. The walls opposite to the opening comprise recesses or grooves 54. The recesses or grooves 54 receive protrusions or rips being formed at the front surface of the die halves 5, 6. Preferably the die halves 5, 6 are held by frictional lock between the protrusions or rips and the recesses or grooves 54 in the die receivers 4*a*, 4*b*. For the embodiment shown in FIG. 14 the die holders 2, 3 are built by two parts with a base body 55 and a holding body 56. The receiving spaces 53*a*, 53*b* are limited by the base body 55 and by the holding body 56 (wherein the transition from the base body 55 to the holding body 56 is located approximately in the middle of the receiving spaces 53*a*, 53*b*). The surfaces limiting the groove 54 and having a normal vector with an orientation parallel to the x-axis are limited both by the base body 55 and the holding body 56. When inserting the holding body 56 into the base body 55 and pressing the holding body 56 towards the base body 55 (e.g. by screwing a screw) the lateral limiting surfaces of the grooves 54*a*, 54*b* of the holding body 56 are pressed towards the opposing limiting surfaces of the grooves 54*a*, 54*b* being built by the base body 55*a*, 55*b*. This leads to a clamping of the protrusions or rips of the die halves 5, 6 in the grooves 54. In the region of the holding body 56 limiting the receiving spaces 53 the holding body 56 has a U-shape in a section in the x-y-plane. The ends of the parallel side legs of the U limits the grooves 54*a*, 54*b*. It is also possible that the transverse leg of the U also extends beyond the side legs for providing a fixation region for a screw between the base body 55 and the holding body 56 (screw not shown in FIG. 14).

Figure 15:
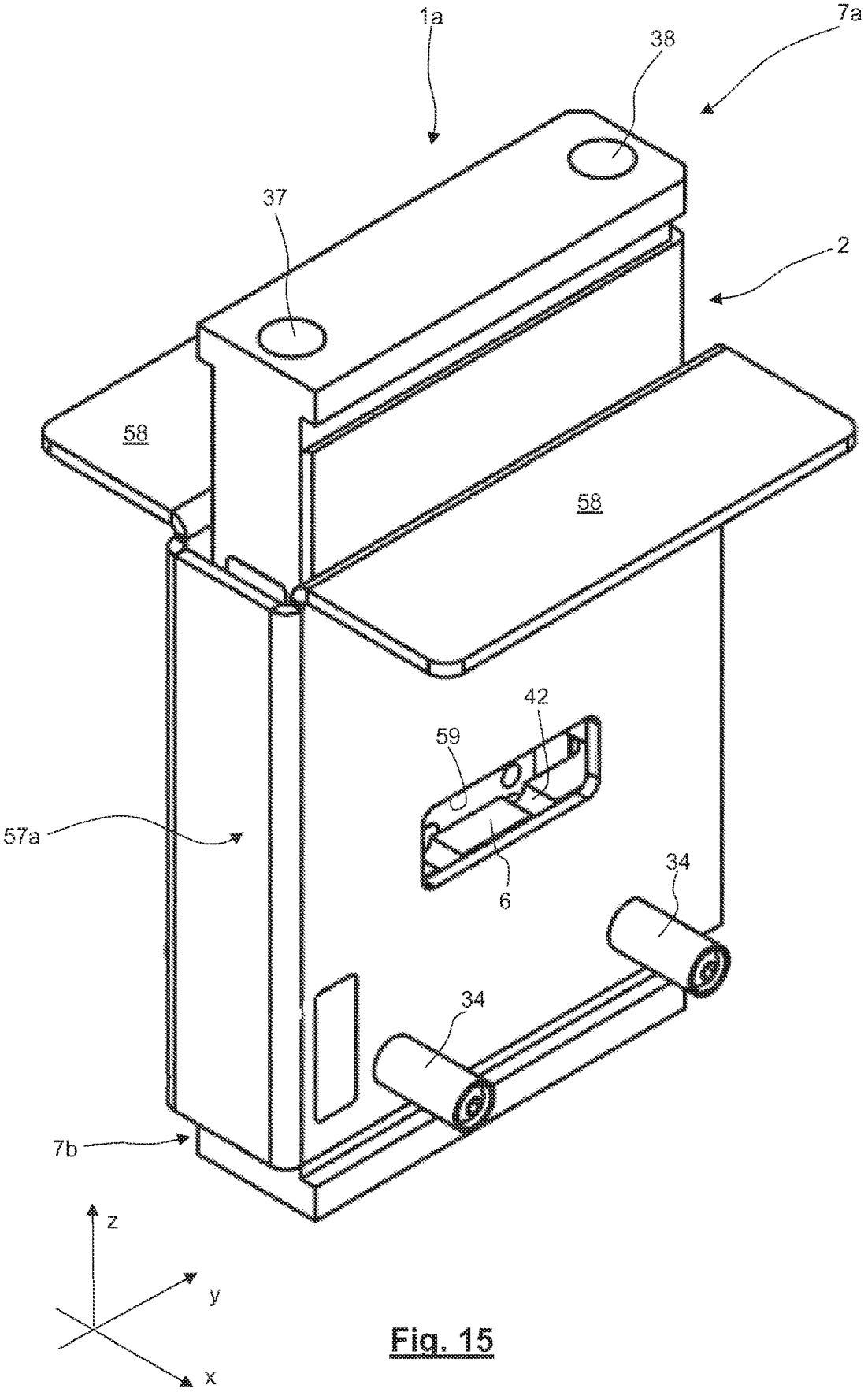
FIGS. 15 and 16 show crimp units of FIGS. 11 and 14 with a protective cover in a three dimensional view.

FIG. 15 shows a crimp unit 1*a* of FIG. 11 with an additional protective cover 57*a*. The protective cover 57*a* is in a first approximation a hollow block with constant wall thickness. The hollow block is open at the bottom and ceiling so that the die holders 2, 3 might enter from the upper side and from the lower side into the protective cover 57*a*. By the handling means 34 extending through bores of the protective cover 57*a* the protective cover 57*a* is fixed at the die holder 3 whereas during the crimping process a relative movement of the die holder 2 with respect to the protective cover 57 is allowed. The protective cover 57*a* might also have plates 58 extending along the x-y-axis. The plates 58 build handling surfaces. The protective cover 57*a* comprises approximately rectangular recesses 59 in the walls extending in the y-z-plane. It is possible that during the crimping process a work piece (in particular the plug with the cable) extends through these recesses 59 into the crimp unit. The protective cover 57*a* is built by a transparent plastic material so that it is possible that before, during and/or after the crimping process the operator inspects the die halves 5, 6 and the work piece through the transparent material of the protective cover 57*a* with a viewing direction parallel to the y-axis.

Figure 16:
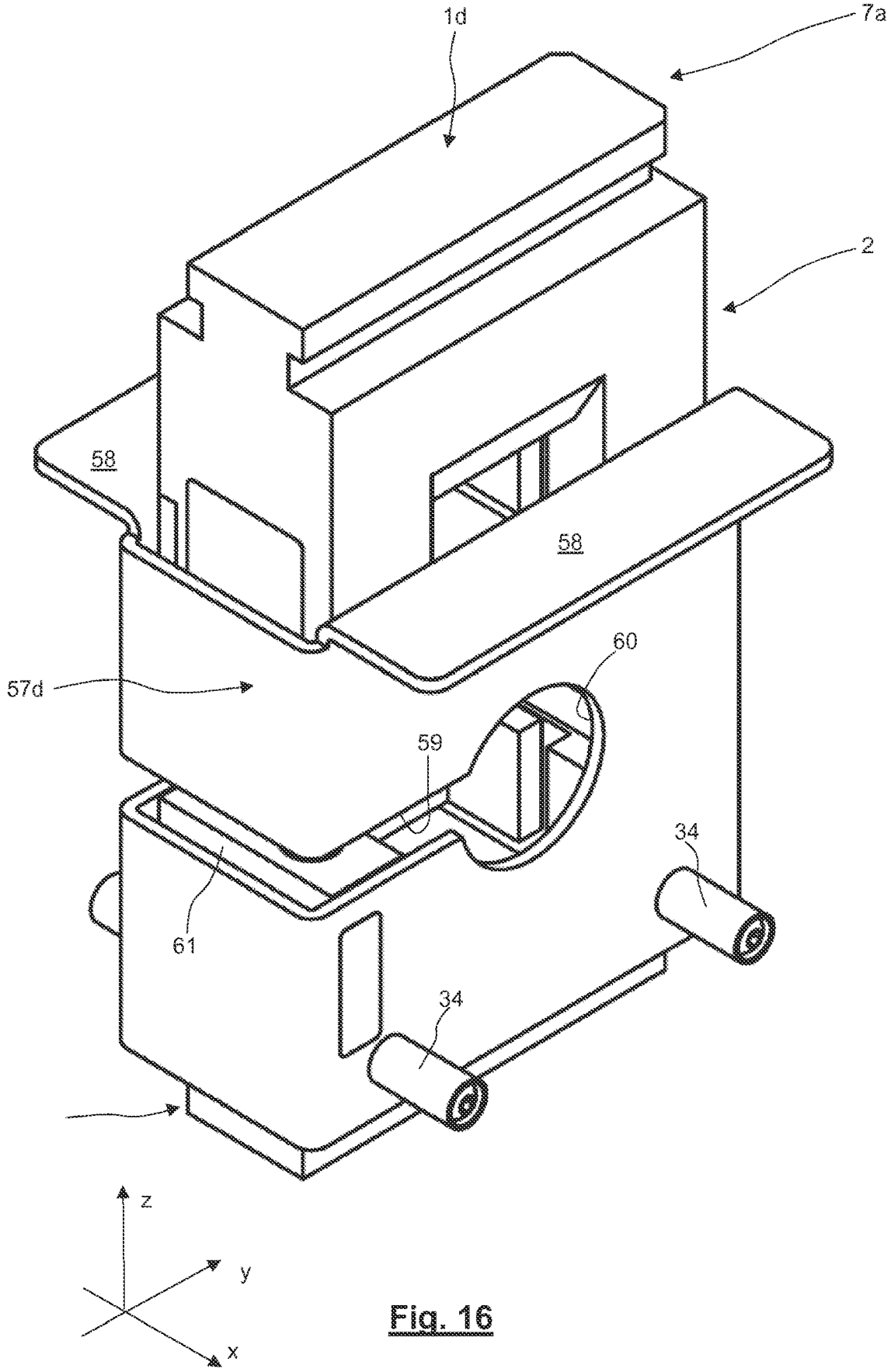

The protective covers 57 might differ in their design for the different crimp units 1*a*-1*d*. As an example FIG. 16 shows a protective cover 57*d* usable for the crimp unit 1*d* according to FIG. 14. The size of the hollow block of the protective cover 57*d* is adapted to the increased dimension of the crimp unit 1*d* along the x-axis. Instead of two rectangular recesses 59 as shown in FIG. 15 only one single recess 59 is provided. The recess 59 is in this case built by two circular recesses 60 of the walls having an extension in the y-z-plane. The two circular recesses 60 are linked by a slot 61 extending in an x-y-axis along the circumference of the protective cover 57*d*.

Figure 17:
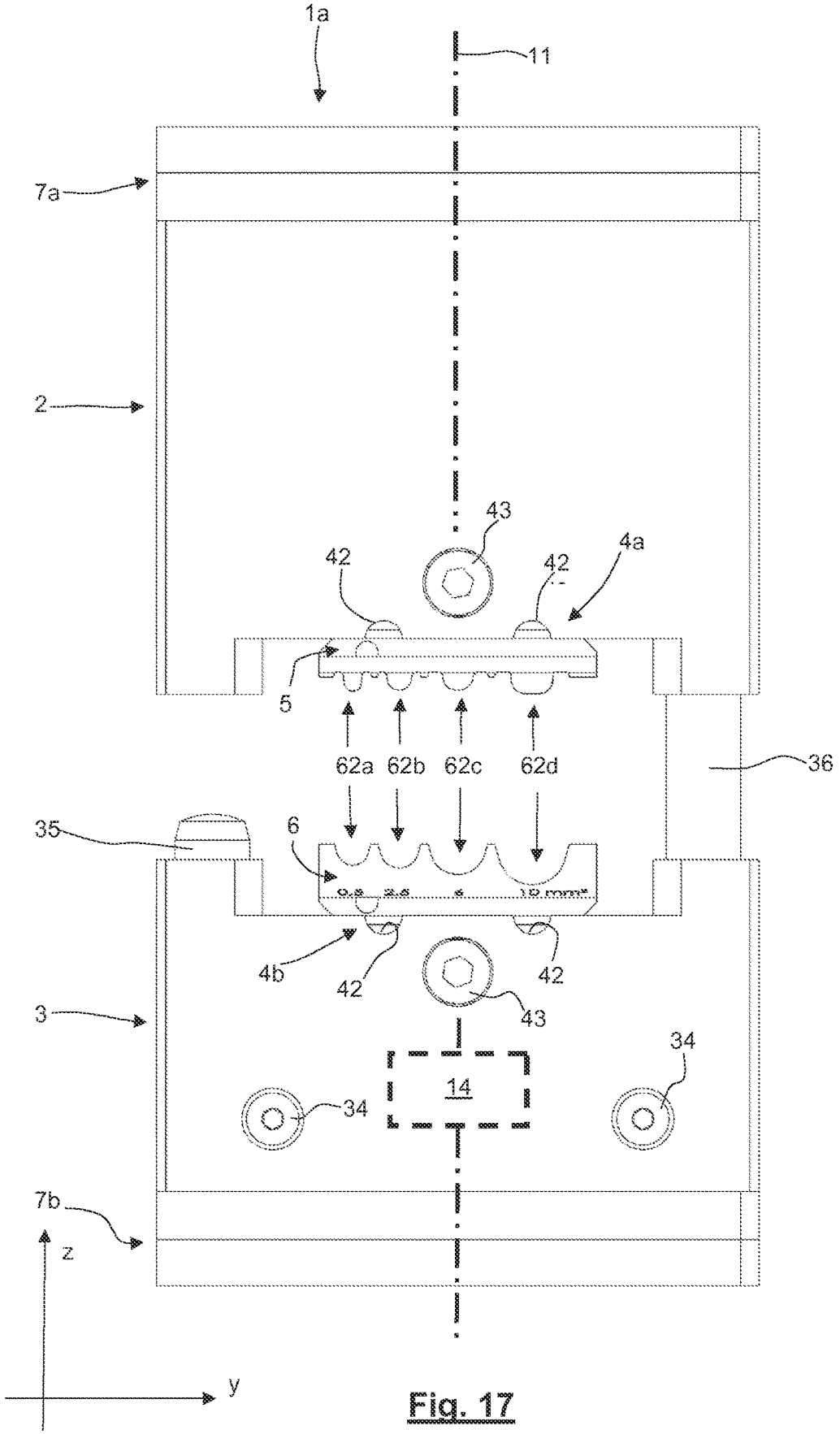
FIGS. 17 and 18 show a crimp unit in a side view (viewing direction opposite to x-axis), wherein the die holders hold different dies.

According to FIG. 17 the die halves 5, 6 used in a crimp unit 1 might comprise a plurality of nests 62*a*-*d* located one besides another along the y-axis. The nests 62*a*-*d* might e.g. differ in size, contour or geometry. In FIG. 17 the sensor 14 is indicated by a symbol. The sensor 14 is located centrally to the die halves 5, 6 when seen along the crimping axis 11. In case that a work piece is crimped in the central nest 62*c*, the sensor 14 is located centrally and behind the crimping nest 62*c* when seen along the crimping axis 11. Accordingly, a major part of the crimp force 13 passes the sensor 14. The die holders 2, 3 as well as the sensor 14 are biased by symmetrical forces and tensions. Instead, when using the nests 62*a*, 62*b*, 62*d* the die holders 2, 3 are biased by asymmetric forces and tensions. Only a reduced component of the crimping force passes the sensor. This reduced component might be considered by a modified calibration factor.

Figure 18:
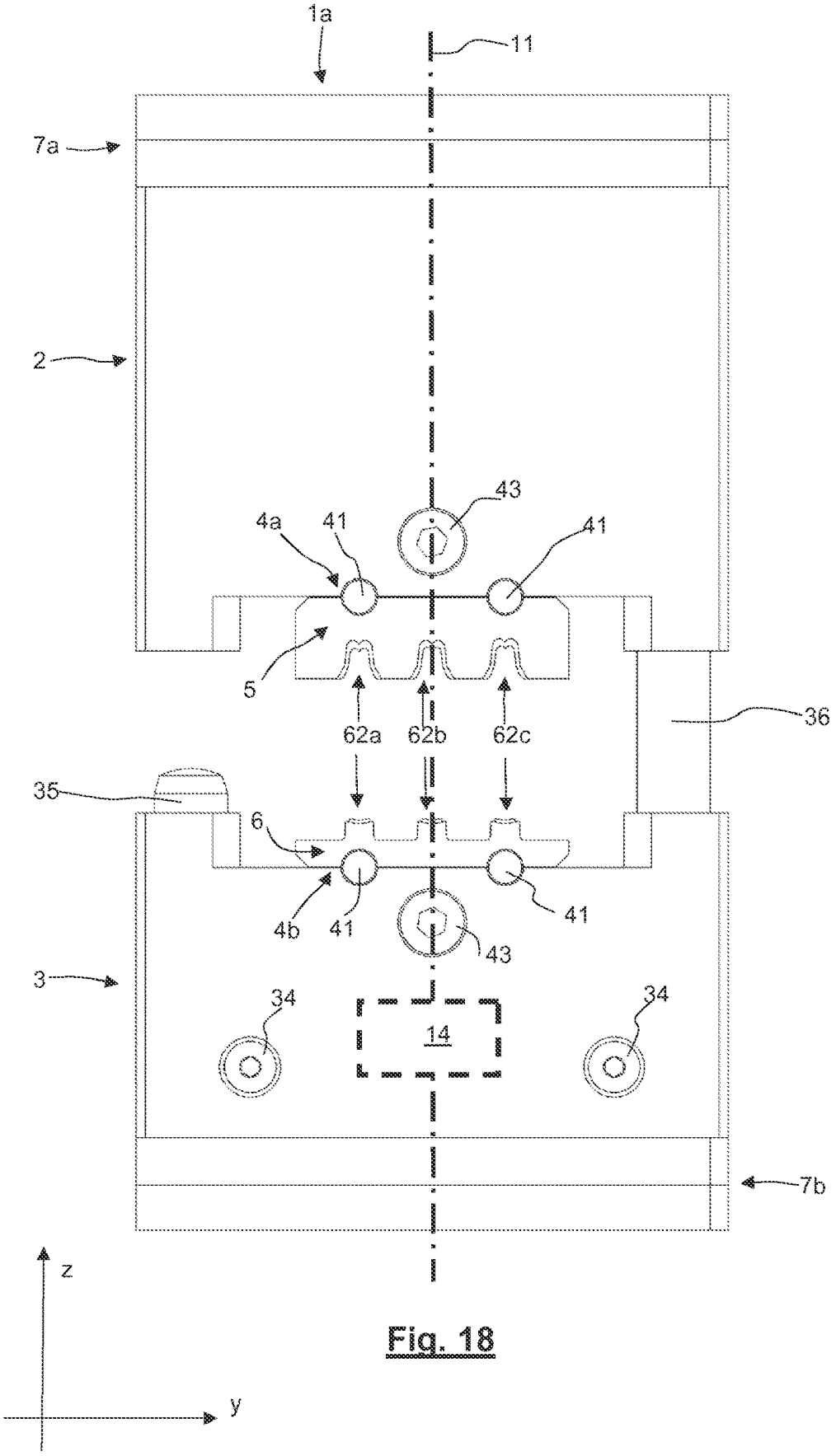

FIG. 18 shows the use of the crimp unit 1*a* with different die halves 5, 6. In these die halves 5, 6 only three nests 62*a*-*c* are provided having different die contours.

Figure 19:
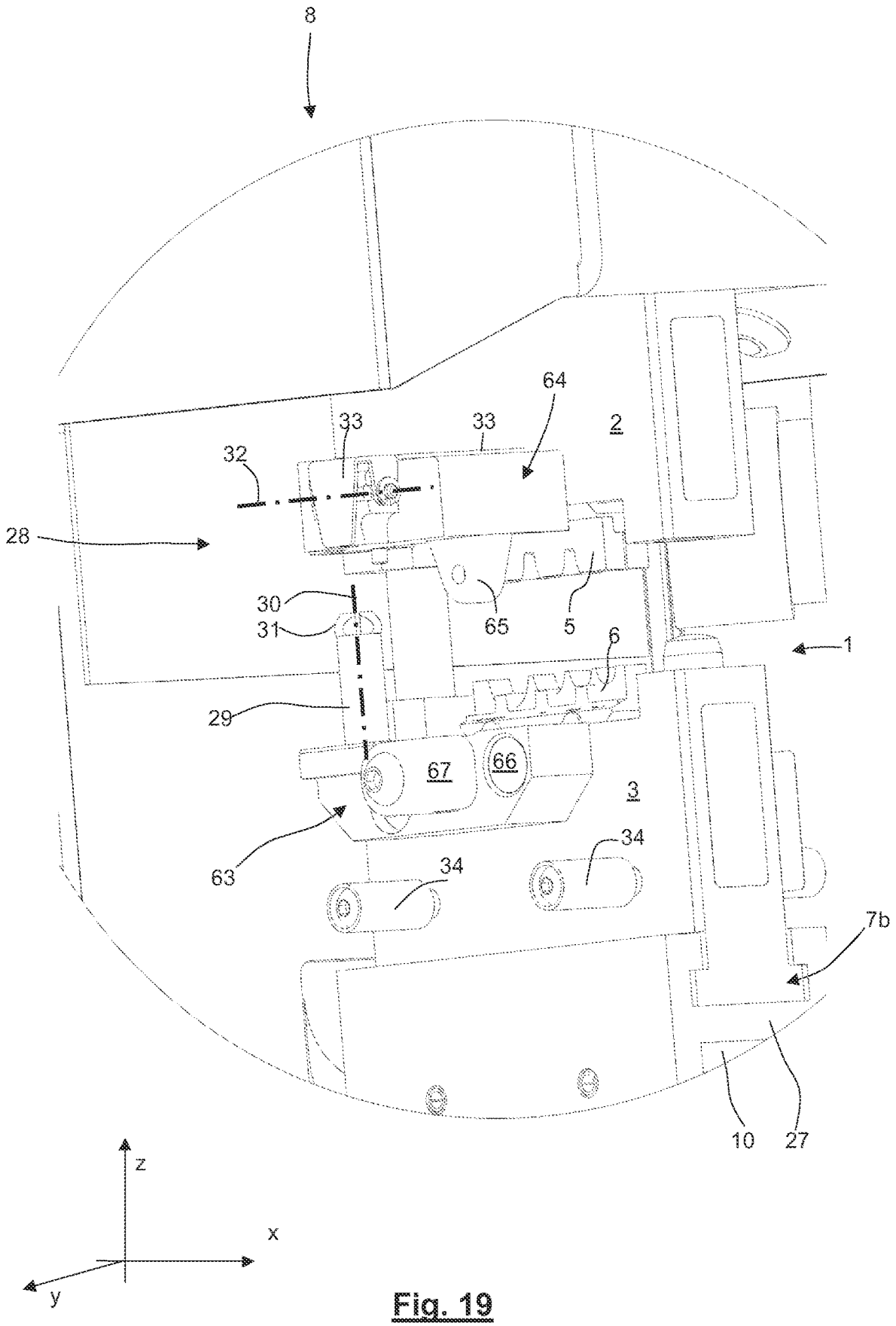
FIG. 19 shows a detail of a crimping machine with a crimp unit having a locator in an explosional view.
Figure 20:
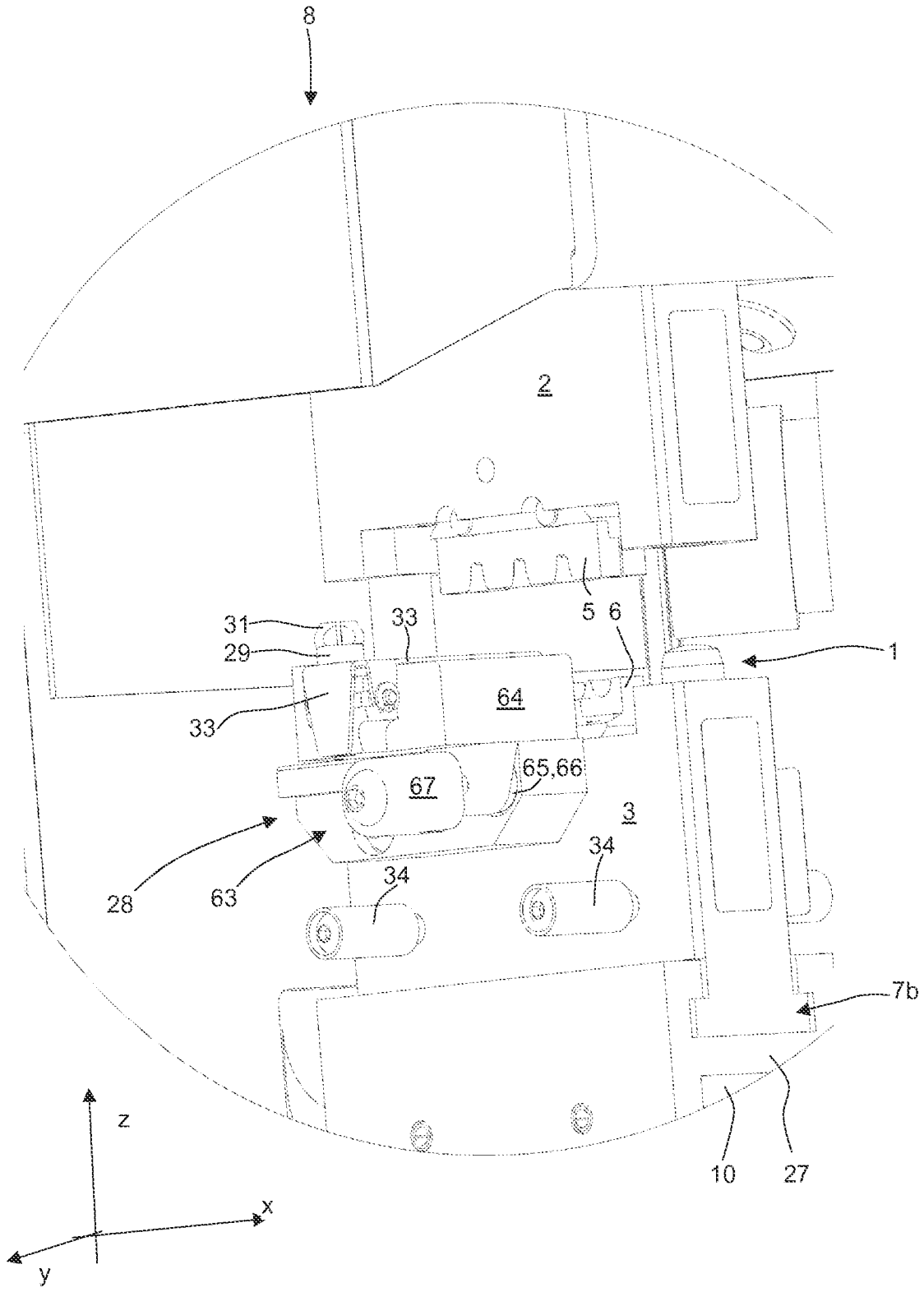
FIG. 20 shows a detail of the crimping machine with crimp unit and locator according to FIG. 19 wherein the locator is located in an operational state.

According to FIGS. 19 and 20 the crimp unit 1 might (permanently or optionally) be provided with a locator. The base design, degrees of freedom and function as well as the interaction of the locator with the work piece and the fixation of the locator at the die holders is e.g. described in the patent application DE 10 2010 061 148 A1 and further documents cited in this patent application. As an example FIGS. 19 and 20 show a locator 28 in a type of explosional view. A base body 63 is fixed at the die holder 3. A pivoting body 64 is held by a pivoting bolt 29 at the base body 63. The pivoting bolt 29 defines the pivoting axis 30. The pivoting body 64 comprises a bore. The pivoting bolt 29 in the assembled state extends through this bore.

In the state shown in FIG. 20 the holding unit 33 is closed so that the work piece is held and fixed in the locator with a predetermined position and orientation. Furthermore, the pivoting body 64 is pivoted around the pivoting axis 32 from an open state into a closed state. By means of this pivoting movement the work piece is brought into a predetermined position and orientation with respect to the die halves 5, 6. The pivoting state of the pivoting body is secured by one, preferably two redundant fixation devices. According to the shown embodiment the base body 63 and the pivoting body 64 comprise magnetic elements 65, 66 building the fixation device. The magnetic elements 65, 66 hold the pivoting body in the state shown in FIG. 20. Preferably the magnetic elements 65, 66 contact each other in the pivoting state according to FIG. 20. Furthermore, a securing element 67 for a redundant fixation might be provided.

Figure 21:
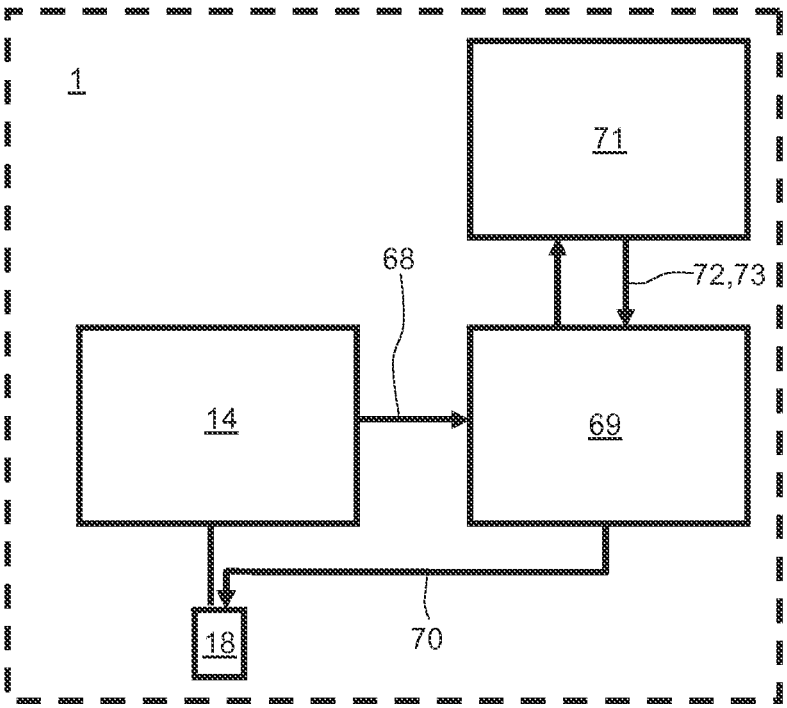
FIG. 21 shows a schematic block diagram of the flow of electric power and signals in a crimp unit with an integrated sensor and an integrated control unit.

FIG. 21 schematically shows the flow of energy and signals in the crimp unit 1. The sensor 14 is provided with electrical energy via a plug or an interface 18. The output signal 68 of the sensor 14 correlating with a predetermined characteristic or dependency on the crimping force 13 is supplied or fed to a control unit 69 integrated into the crimp unit 1. In the control unit 69 a modified output signal 70 is determined which is then supplied to the plug or interface 18. The modified output signal 70 might be calculated from the output signal 68 by a constant calibration factor or a calibration curve (or on the basis of any different dependency). The calibration factor 72 or calibration curve 73 might be stored in a storage unit 71. The control unit 69 reads the calibration factor 72 or calibration curve 73 from the storage unit 71. The calibration factor 72 or the calibration curve 73 might be stored in the storage unit 71 at the manufacturer. However, it is also possible that the calibration factor 72 or the calibration curve 73 is considered and programmed in the control logic of the control unit 69. It is also possible that with the startup of the crimping machine 8 an individual calibration process is run for determining and storing the calibration factor 72, the calibration curve 73 or any other dependency which is then stored in the storage unit 71. Furthermore, it is possible that different calibration factors 72 or calibration curves 73 are used for operating the nests 62*a*, 62*b*, 62*c*, 62*d*. Also for different crimp units 1*a*, 1*b*, 1*c*, 1*d* different calibration factors 72, calibration curve 73 or other dependencies might be used. The modified output signal 70 is then transmitted to a respective interface 75 of an adjacent element via the plug or interface 18 for further processing and/or for documentation purposes. In particular the adjacent element builds a part of the crimping machine 8.

Figure 22:
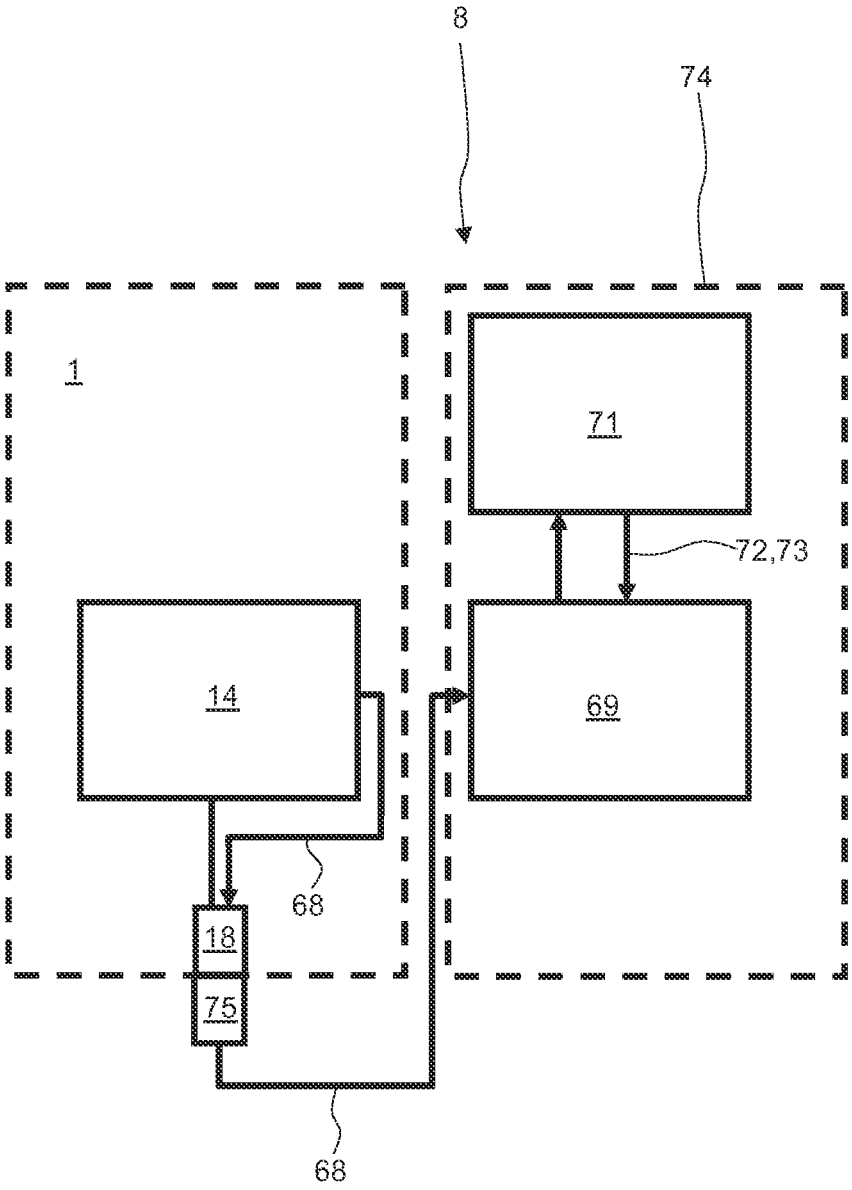
FIG. 22 is a schematic block diagram with the flow of signals and power in a crimp unit with integrated sensor and a control unit located externally from the crimp unit.

For a modified embodiment shown in FIG. 22 the control unit 69 and the storage unit 71 are built externally from the crimp unit 1. These elements might be located at any position of the crimping machine 8. Preferably the storage unit 71 and the control unit 69 build a singular unit with one housing or with at least two modules. According to FIG. 22 it is possible to transfer the output signal 68 of the sensor directly to a plug or a interface 18. The plug or interface 18 cooperates with a respective plug or interface 75 for transferring the output signal 68 to the control unit 69. In the control unit 69 the output signal 68 is processed to a modified output signal 70 under use of the calibration factor 72, the calibration curve 73 or any other dependency.

In the specification related with the figures the letter a is added to the reference numerals to denote crimp units 1 of differing design, in particular with respect to the design of the die receivers 4 and/or the coupling regions 7. In other cases the letters a and b have been used in order to distinguish constructive elements having corresponding functions, wherein constructive elements associated with the die holder 2 are denoted with the letter a, whereas constructive elements associated with the die holder 3 are denoted with the letter b.

A "set of interchangeable crimp units" means at least two crimp units designated for one and the same crimping machine. It is possible to disassemble a first one of the crimp units of the set from the crimping machine and to replace the first crimp unit with a second one of the crimp units of the set.

Many variations and modifications may be made to the preferred embodiments of the invention without departing substantially from the spirit and principles of the invention. All such modifications and variations are intended to be included herein within the scope of the present invention, as defined by the following claims.

We claim:

1. A set of interchangeable crimp units for a crimping machine, said crimp units each comprising two die holders and two coupling regions for releasably coupling said die holders with the crimping machine, wherein said crimp units each comprise a sensor for at least one of sensing a crimping force or a crimping distance, and an independent control unit, wherein said control unit comprises control logic for processing a measurement signal of said sensor, wherein calibration factors or calibration curves are modelled or stored in the control unit or in a storage unit also integrated into the crimp unit, and the control unit is designed and configured such that during the use of the crimp unit in the crimping machine, the control unit determines a modified output signal under consideration of the calibration factor or calibration curve so that the crimp unit supplies an adapted or modified output signal, wherein in the modified signal, the calibration factor or calibration curve is already considered.

2. The set of interchangeable crimp units of claim 1, wherein each of said crimp units comprises a protective cover.

3. The set of interchangeable crimp units of claim 2, wherein said protective cover is at least partially built by a transparent or translucent material.

4. The set of interchangeable crimp units of claim 1, wherein a first die holder of said two die holders of each of said crimping units is guided by a second die holder of said two die holders of each of said crimping units.

5. The set of interchangeable crimp units of claim 4, wherein said first die holder comprises a guiding pin extending through a guiding recess of said second die holder.

6. The set of interchangeable crimp units of claim 5, wherein said first or second die holder comprises another guiding pin and said two guiding pins are located on opposing sides of a nest of a die being held by said die holders.

7. The set of interchangeable crimp units of claim 6, wherein said two guiding pins have different lengths wherein the longer guiding pin of said two guiding pins enters into a respective guiding recess before the shorter guiding pin of said two guiding pins enters into a respective guiding recess.

8. The set of interchangeable crimp units of claim 1, wherein said sensor for at least one of sensing a crimping force or a crimping distance is located centrally behind one of said die holders when seen along a crimping axis.

9. The set of interchangeable crimp units of claim 1, wherein said die holders are designed and configured for holding a die having a plurality of nests.

10. The set of interchangeable crimp units of claim 1, wherein at least one of at least one interface or at least one plug is provided at each of said crimp units wherein said interface or plug supplies said sensor with electrical energy or transfers a measurement signal of said sensor.

11. The set of interchangeable crimp units of claim 10, wherein said crimp units have at least one of differing geometries or sensors and at least one of unique interfaces or plugs.

12. The set of interchangeable crimp units of claim 1, wherein said crimp units have at least one of differing coupling regions, sensors, geometries, die holders, plugs and interfaces.

13. The set of interchangeable crimp units of claim 1, wherein said sensors of said crimp units have differing sensitivities.

14. A crimping machine comprising a set of interchangeable crimp units of claim 1.

15. The crimping machine of claim 14, wherein said control unit is provided, said control unit comprising control logic for determining crimping forces or crimping displacements from measurement signals of said sensors of said crimp units of said set of interchangeable crimp units under consideration of calibration factors or calibration curves.

16. The crimping machine of claim 15, wherein said control logic uses at least one of differing calibration factors or calibration curves for each of said crimp units of said set of interchangeable crimp units.

17. The crimping machine of claim 16, wherein said control logic uses at least one of differing calibration factors or calibration curves for different nests of a die held by said die holders.

* * * * *